US007760167B2

(12) United States Patent
Uchino et al.

(10) Patent No.: US 7,760,167 B2
(45) Date of Patent: Jul. 20, 2010

(54) DISPLAY APPARATUS AND ELECTRONIC DEVICE

(75) Inventors: Katsuhide Uchino, Kanagawa (JP); Junichi Yamashita, Tokyo (JP); Tetsuo Minami, Tokyo (JP)

(73) Assignee: Sony Corporation, Tokyo (JP)

( * ) Notice: Subject to any disclaimer, the term of this patent is extended or adjusted under 35 U.S.C. 154(b) by 540 days.

(21) Appl. No.: 11/878,514

(22) Filed: Jul. 25, 2007

(65) Prior Publication Data

US 2008/0024400 A1 Jan. 31, 2008

(30) Foreign Application Priority Data

Jul. 27, 2006 (JP) ..... 2006-204055

(51) Int. Cl.
*G09G 3/30* (2006.01)

(52) U.S. Cl. ..... 345/76; 345/82; 345/90; 345/92; 315/169.1; 315/169.3

(58) Field of Classification Search ..... 345/39, 345/44–46, 76–84, 204–214, 690–693, 85–100; 315/169.1–169.3
See application file for complete search history.

(56) References Cited

U.S. PATENT DOCUMENTS 6,356,029 B1 * 3/2002 Hunter ..... 315/169.1
7,605,789 B2 * 10/2009 Uchino et al. ..... 345/92
7,646,363 B2 * 1/2010 Yamashita et al. ..... 345/76
7,659,872 B2 * 2/2010 Yamashita et al. ..... 345/80

FOREIGN PATENT DOCUMENTS

| | | |
|---|---|---|
| JP | 2003-255856 | 9/2003 |
| JP | 2003-271095 | 9/2003 |
| JP | 2004-029791 | 1/2004 |
| JP | 2004-093682 | 3/2004 |
| JP | 2004-133240 | 4/2004 |

* cited by examiner

*Primary Examiner*—Lun-Yi Lao
*Assistant Examiner*—Jennifer T Nguyen
(74) *Attorney, Agent, or Firm*—Rader, Fishman & Grauer PLLC

(57) ABSTRACT

A display apparatus includes a pixel array section and a drive section that drives the pixel array section. The pixel array section includes first scanning lines and second scanning lines arranged in rows, signals lines arranged in columns, matrix pixels that are provided at a position where the first scanning lines, the second scanning lines, and the signal lines cross, a power line that supplies power to each of the pixels, and an earth line. The drive section includes a first scanner that sequentially line scans the pixels per each row by sequentially supplying a first control signal to each of the first scanning lines, a second scanner that sequentially supplies a second control signal to each of the second scanning lines in conjunction with the sequential line scanning, and a signal selector that supplies video signals to the columns of signal lines in conjunction with the sequential line scanning.

9 Claims, 19 Drawing Sheets

$$I_{ds} = k\mu (V_{gs}-V_{th})^2 = k\mu (V_{sig}-\Delta V)^2$$

DISPLAY APPARATUS AND ELECTRONIC DEVICE

BACKGROUND OF THE INVENTION

1. Field of the Invention

The present invention relates to a display apparatus that displays images by driving light emitting elements arranged by pixels by an electric current. More specifically, the present invention relates to a display apparatus of the so-called active matrix type in which the amount of current that is passed to a light emitting element, such as an organic EL and the like, is controlled by an insulated, gate field effect transistor that is provided in each pixel circuit. Furthermore, the present invention relates to a display apparatus in which a transistor mobility correction function is incorporated into each pixel. In addition, the present invention relates to an electronic device that incorporates such a display apparatus.

2. Description of Related Art

In image displaying apparatuses, such as liquid crystal displays, for example, numerous liquid crystal pixels are arranged in a matrix, and an image is displayed by controlling the reflection intensity or transmission intensity with respect to the incident light for each pixel in accordance with the image information for the image to be displayed. The same principle applies to an organic EL display that uses organic EL elements for pixels, but unlike liquid crystal pixels, organic EL elements emit light themselves. As a result, organic EL displays offer advantages over liquid crystal displays such as better visibility of image, faster response speed, not requiring a backlight, and so forth. In addition, the brightness level (scale) of each light emitting element is controllable by way of the value of the current that flows therethrough, and thus organic EL displays differ from liquid crystal displays, which are controlled by voltage, in that they are controlled by current.

With organic EL displays, as with liquid crystal displays, there is the simple matrix method and the active matrix method with respect to their driving methods. While the former has a simple structure, it has a problem in that application to large and high definition displays is difficult. As a result, development of the active matrix method is currently being actively pursued. This method is one in which the current that flows to the light emitting element within each pixel circuit is controlled by an active element (generally, a thin film transistor (TFT)) that is provided within the pixel circuit, and descriptions thereof can be found in the following patent documents.

[Patent Document 1] Japanese Patent Application Publication No. JP 2003-255856

[Patent Document 2] Japanese Patent Application Publication No. JP 2003-271095

[Patent Document 3] Japanese Patent Application Publication No. JP 2004-133240

[Patent Document 4] Japanese Patent Application Publication No. JP 2004-029791

[Patent Document 5] Japanese Patent Application Publication No. JP 2004-093682

SUMMARY OF THE INVENTION

A related art pixel circuit is provided at a position where a row of a scanning line that supplies control signals and a column of a signal line that supplies video signals cross, and includes at least a sampling transistor, a pixel capacitance, a drive transistor, and a light emitting element. The sampling transistor becomes conductive in accordance with the control signal supplied by the scanning line, and samples the video signal supplied by the signal line. The pixel capacitance holds an input voltage corresponding to the signal potential of the video signal that has been sampled. The drive transistor supplies as a drive current an output current during a predetermined light emitting period in accordance with the input voltage held by the pixel capacitance. It is noted that, in general, the output current is dependent on the carrier mobility of the channel region and the threshold voltage of the drive transistor. The light emitting element emits light at a brightness corresponding to the video signal by means of the output current that is supplied by the drive transistor.

The drive transistor receives the input voltage held by the pixel capacitance at its gate and allows an output current to flow between its source and drain, thereby allowing a current to flow to the light emitting element. In general, the light emitting brightness of the light emitting element is proportional to the amount of current applied. Further, the amount of the output current supplied by the drive transistor is controlled by the gate voltage; in other words, the input voltage written in the pixel capacitance. In a related art pixel circuit, the amount of current that is supplied to the light emitting element is controlled by varying the input voltage applied to the gate of the drive transistor in accordance with the input video signal.

The operating characteristics of the drive transistor can be expressed by Equation 1 below:

$$Ids=(1/2)\mu(W/L)Cox(Vgs-Vth)^2 \qquad \text{Equation 1}$$

In Equation 1, Ids represents the drain current that flows between the source and the drain, and in the pixel circuit, it is the output current that is supplied to the light emitting element. Vgs represents the gate voltage that is applied to the gate with the source as a reference, and in the pixel circuit, it is the input voltage. Vth is the threshold voltage of the transistor. In addition, μ represents the mobility of the semiconductor thin film that makes up the channel of the transistor. W represents the channel width, L represents the channel length, and Cox represents the gate capacitance. As can be seen from Equation 1, when the thin film transistor operates in the saturation region, as the gate voltage Vgs increases in excess of the threshold voltage Vth, it enters an ON state and the drain current Ids flows. In principle, as is indicated by Equation 1, as long as the gate voltage Vgs is uniform, a constantly same amount of drain current Ids is supplied to the light emitting element. Therefore, if a video signal of the same level is supplied to all the pixels making up a screen, all pixels should emit light with the same brightness, and uniformity of the screen should be achieved.

However, in practice, thin film transistors (TFT) that include a semiconductor thin film of, for example, polysilicon and the like vary in their device characteristics. In particular, the threshold voltage is not uniform, and varies from pixel to pixel. As can be seen from Equation 1 above, when the threshold voltage Vth of each drive transistor varies, the drain current Ids will vary even if the gate voltage Vgs is uniform, causing the brightness to vary from pixel to pixel, and the uniformity of the screen is thus compromised. Pixel circuits with built-in functions for cancelling variations in the threshold voltage of drive transistors have been developed and are disclosed in, for example, Patent Document 3 mentioned above.

What causes the output current supplied to the light emitting element to vary is not just the threshold voltage Vth of the drive transistor. As can be seen from Equation 1 above, the output current Ids varies even when the mobility μ of the drive transistor varies, thereby impairing the uniformity of the screen. Correcting for variations in mobility is also an issue to be resolved.

In view of the issues described above that are associated with related art technology, it is desirable to provide a display apparatus in which a drive transistor mobility correction function is incorporated into each of its pixels. It is also desirable to provide a display apparatus in which mobility correction can be performed adaptively with respect to different brightness levels. In an embodiment of the present invention, the following measures are taken. A display apparatus of the present embodiment includes a pixel array section and a drive section that drives the pixel array section. The pixel array section includes rows of first scanning lines and second scanning lines, columns of signal lines, a matrix of pixels provided at a position where the first and second scanning lines and signal lines cross, a power line that provides power to each of the pixels, and an earth line. The drive section includes a first scanner that sequentially supplies a first control signal to each of the first scanning lines and that sequentially line scans the pixels row by row, a second scanner that sequentially supplies a second control signal to each of the second scanning lines in accordance with the sequential line scanning, and a signal selector that supplies video signals to the columns of signal lines in accordance with the sequential line scanning. Each of the pixels includes a light emitting element, a sampling transistor, a drive transistor, a switching transistor, and a pixel capacitance. With respect to the sampling transistor, its gate is connected to the first scanning line, its source is connected to the signal line, and its drain is connected to the gate of the drive transistor. The drive transistor and the light emitting element are connected in series between the power line and the earth line to form a current path. The switching transistor is inserted in the current path, and its gate is connected to the second scanning line. The pixel capacitance is connected between the source and the gate of the drive transistor. In such a display apparatus, the sampling transistor turns on in response to the first control signal that is supplied from the first scanning line, samples the signal potential of the video signal supplied from the signal line and holds it in the pixel capacitance. The switching transistor turns on in response to the second control signal supplied from the second scanning line to turn the current path in a conductive state. The drive transistor, in accordance with the signal potential held by the pixel capacitance, passes a drive current to the light emitting element via the current path that is placed in a conductive state. After applying the first control signal to the first scanning line to turn on the sampling transistor and starting the sampling of the signal potential, the drive section corrects the signal potential held by the pixel capacitance in accordance with the mobility of the drive transistor during a correction period, which is from a first timing at which the switching transistor turns on when the second control signal is applied to the second scanning line up to a second timing at which the sampling transistor turns off when the first control signal applied to the first scanning line is terminated. The first scanner includes an output section for giving a gradient to the trailing end of the first control signal, which governs the second timing. By outputting a curved gradient waveform in which the gradient is initially made steep and then made gentler, the output section optimizes the correction period for both a case where the signal potential is high as well as a case where the signal potential is low.

In one embodiment, the output section of the first scanner may include an output buffer that is provided between the power line and the earth line and that includes a transmission gate, and when the transmission gate opens in conjunction with the sequential line scanning, a curved gradient waveform is extracted from the power source pulse supplied to the power line and is outputted to the first scanning line as the first control signal. In another embodiment, the output section of the first scanner may be equipped with an output buffer that is provided between the power line and the earth line and that includes a P-channel transistor, and when the P-channel transistor opens in conjunction with the sequential line scanning, a gradient waveform that bends linearly is extracted from the power source pulse supplied to the power line and is outputted to the first scanning line as the first control signal after being modified to a curved gradient waveform. In a different embodiment, the output section of the first scanner may be equipped with an output buffer of an inverter configuration, and outputs to the first scanning line the first control signal having a curved gradient waveform by blunting an input signal having a rectangular waveform. In this case, the output section of the first scanner utilizes the operating characteristics of a P-channel transistor included in the inverter configuration to blunt the input signal having a rectangular waveform. Alternatively, the output section of the first scanner may blunt the input signal having a rectangular waveform by making the size factor of another transistor making up the first scanner smaller than the size factor of the transistor included in the inverter configuration. In some cases, the output section of the first scanner may blunt the trailing waveform outputted from the output buffer to a curved gradient waveform utilizing the time constant that is determined by the wiring resistance and wiring capacitance of the first scanning line. It is preferable that each pixel include an additional switching transistor that resets the gate potential and source potential of the drive transistor prior to the sampling of the video signals, and that the second scanner temporarily turn on the switching transistor via the second scanning lines prior to the sampling of the video signal, apply a drive current to the drive transistor that is thus reset, and hold a voltage corresponding to the threshold voltage thereof in the pixel capacitance.

According to the embodiments of the present invention, utilizing a pixel capacitance is connected between the source and the gate of the drive transistor. In such a display apparatus, the sampling transistor turns on in response to the first control signal that is supplied from the first scanning line, samples the signal potential of the video signal supplied from the signal line and holds it in the pixel capacitance. The switching transistor turns on in response to the second control signal supplied from the second scanning line to turn the current path in a conductive state. The drive transistor, in accordance with the signal potential held by the pixel capacitance, passes a drive current to the light emitting element via the current path that is placed in a conductive state. After applying the first control signal to the first scanning line to turn on the sampling transistor and starting the sampling of the signal potential, the drive section corrects the signal potential held by the pixel capacitance in accordance with the mobility of the drive transistor during a correction period, which is from a first timing at which the switching transistor turns on when the second control signal is applied to the second scanning line up to a second timing at which the sampling transistor turns off when the first control signal applied to the first scanning line is terminated. The first scanner includes an output section for giving a gradient to the trailing end of the first control signal, which governs the second timing. By outputting a curved gradient waveform in which the gradient is initially made steep and then made gentler, the output section optimizes the correction period for both a case where the signal potential is high as well as a case where the signal potential is low.

In one embodiment, the output section of the first scanner may include an output buffer that is provided between the power line and the earth line and that includes a transmission gate, and when the transmission gate opens in conjunction with the sequential line scanning, a curved gradient waveform is extracted from the power source pulse supplied to the power line and is outputted to the first scanning line as the first control signal. In another embodiment, the output section of the first scanner may be equipped with an output buffer that is provided between the power line and the earth line and that includes a P-channel transistor, and when the P-channel transistor opens in conjunction with the sequential line scanning, a gradient waveform that bends linearly is extracted from the power source pulse supplied to the power line and is outputted to the first scanning line as the first control signal after being modified to a curved gradient waveform. In a different embodiment, the output section of the first scanner may be equipped with an output buffer of an inverter configuration, and outputs to the first scanning line the first control signal having a curved gradient waveform by blunting an input signal having a rectangular waveform. In this case, the output section of the first scanner utilizes the operating characteristics of a P-channel transistor included in the inverter configuration to blunt the input signal having a rectangular waveform. Alternatively, the output section of the first scanner may blunt the input signal having a rectangular waveform by making the size factor of another transistor making up the first scanner smaller than the size factor of the transistor included in the inverter configuration. In some cases, the output section of the first scanner may blunt the trailing waveform outputted from the output buffer to a curved gradient waveform utilizing the time constant that is determined by the wiring resistance and wiring capacitance of the first scanning line. It is preferable that each pixel include an additional switching transistor that resets the gate potential and source potential of the drive transistor prior to the sampling of the video signals, and that the second scanner temporarily turn on the switching transistor via the second scanning lines prior to the sampling of the video signal, apply a drive current to the drive transistor that is thus reset, and hold a voltage corresponding to the threshold voltage thereof in the pixel capacitance.

According to the embodiments of the present invention, utilizing a part of a period in which the signal potential is sampled to the pixel capacitance (sampling period), the mobility of the drive transistor is corrected. More specifically, in the latter part of the sampling period, the switching transistor is turned on to put the current path in a conductive state, and a drive current is applied to the drive transistor. This drive current has a magnitude corresponding to the sampled signal potential. At this stage, the light-emitting element is in a reverse bias state, and the drive current does not flow to the light-emitting element and is charged to the parasitic capacitance thereof or the pixel capacitance. Then, the sampling pulse falls, and the gate of the drive transistor is cut off from the signal lines. During the correction period from when the switching transistor turns on up to when the sampling transistor turns off, the drive current is negatively fed back to the pixel capacitance from the drive transistor, and an amount corresponding thereto is subtracted from the signal potential sampled by the pixel capacitance. Since this negative feedback amount works in a suppressive manner with respect to variations in the mobility of the drive transistor, mobility can be corrected per each pixel. In other words, when the mobility of the drive transistor is large, the amount of negative feedback with respect to the pixel capacitance becomes greater, the signal potential held by the pixel capacitance is greatly reduced, and the output current of the drive transistor is suppressed as a result. On the other hand, when the mobility of the drive transistor is small, the amount of negative feedback also is small, and the signal potential held by the pixel capacitance is not affected as much. Therefore, the output current of the drive transistor does not decrease much. Here, the amount of negative feedback is at a level that corresponds to the signal potential that is directly applied to the gate of the drive transistor from the signal lines. In other words, as the signal potential becomes higher and the brightness greater, the amount of negative feedback becomes greater. Thus, mobility correction is performed in accordance with the brightness level.

However, the optimum corrective period is not necessarily the same between a case where brightness is high and a case where brightness is low. Generally, the optimum corrective period is relatively short when brightness is at a high level (white level). On the contrary, when brightness is at a medium level (gray level), the optimum corrective period tends to become longer. In the embodiments of the present invention, the correction period is automatically optimized in accordance with the brightness level. In other words, in the embodiments of the present invention, the second timing at which the sampling transistor turns off is, adjusted automatically in accordance with the signal potential, in relation to the first timing at which the switching transistor turns on. More specifically, an adaptive control is exercised where the correction period becomes shorter when the signal potential of the video signal supplied from the signal line is high, while the correction period becomes longer when the signal potential of the video signal supplied to the signal line is low. As a result, the correction period is variably controlled so as to be optimized in accordance with the signal potential. According to such a configuration, the uniformity of the screen can be further improved.

In particular, with the embodiments of the present invention, the adaptive control over the mobility correction period is carried out by using the output section of the first scanner. By outputting a curved gradient waveform in which the trailing end of the first control signal, which defines the end of the correction period (the second timing), is initially modified to have a steep gradient and then made more gentle, the output section optimizes the mobility correction period for both a case where the signal potential is high as well as a case where the signal potential is low.

DETAILED DESCRIPTION OF EMBODIMENTS

Figure 1:
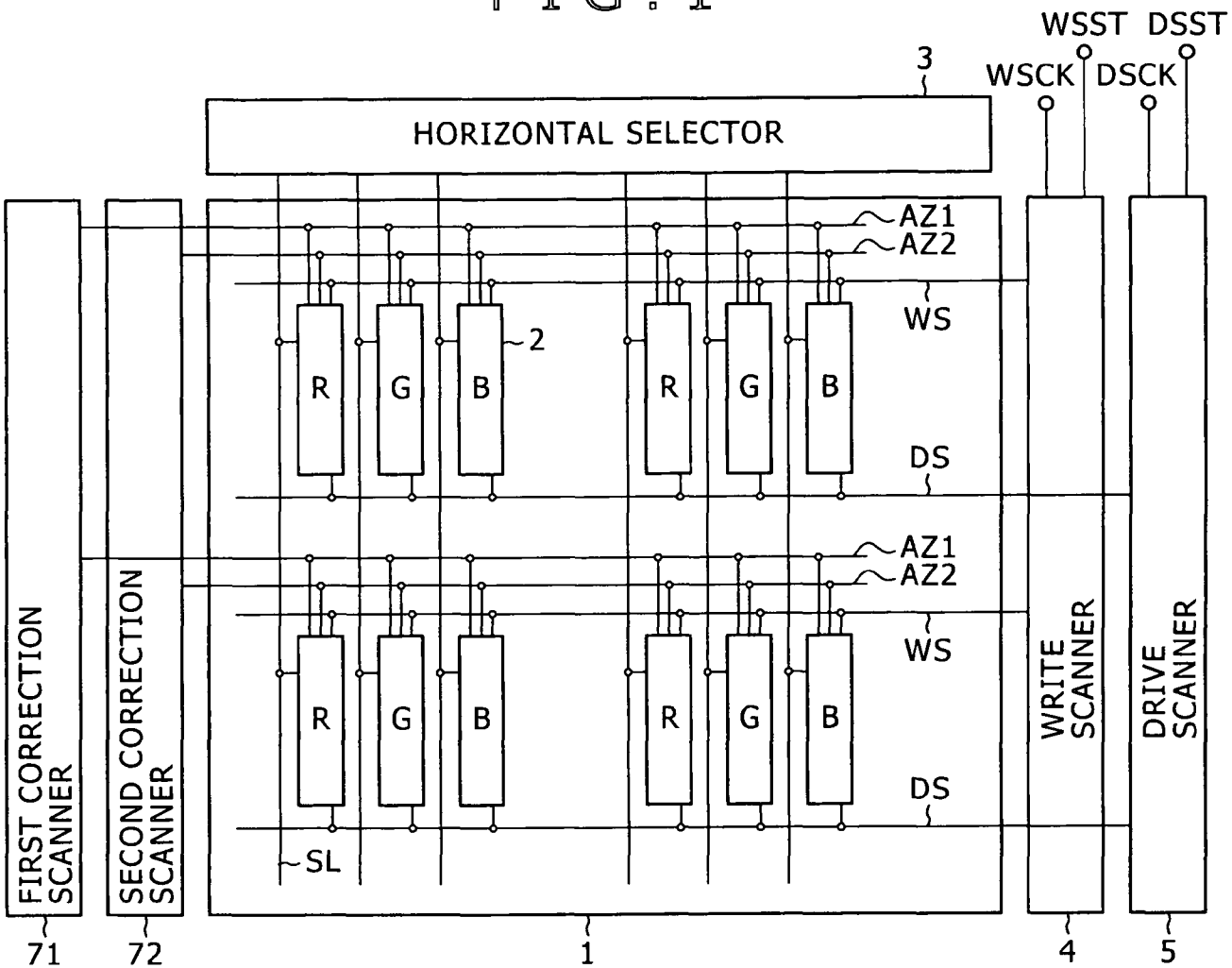
FIG. 1 is a schematic block diagram indicating the overall configuration of a display apparatus according to an embodiment of the present invention.

Embodiments of the present invention are described in detail with reference to the drawings. FIG. 1 is a schematic block diagram indicating the overall configuration of a display apparatus according to an embodiment of the present invention. As shown in the diagram, the image display apparatus basically includes a pixel array section 1 and a drive section that includes a scanner section and a signal section. The pixel array section 1 includes scanning lines WS, AZ1, AZ2 and DS that are arranged in rows, signal lines SL that are arranged in columns, and matrix pixel circuits 2, which are connected to these scanning lines WS, AZ1, AZ2 and DS and the signal lines SL, and a plurality of power lines which supply a first potential Vss1, a second potential Vss2, and a third potential Vcc which are necessary for operation of each of the pixel circuits 2. The signal section includes a horizontal selector 3 and supplies video signals to the signal lines SL. The scanner section includes a write scanner 4, a drive scanner 5, a first correction scanner 71 and a second correction scanner 72, and these scanners supply control signals to the scanning lines WS, DS, AZ1 and AZ2, respectively and sequentially scan the pixel circuits 2 row by row.

The write scanner 4 includes shift registers, operates in accordance with a clock signal WSCK that is supplied from outside, sequentially forwards a start signal WSST that is similarly supplied from outside, and outputs the start signal to each of the scanning lines WS. The drive scanner 5 also includes shift registers, operates in accordance with a clock signal DSCK that is supplied from outside, and sequentially outputs the control signal DS to each of the scanning lines DS by sequentially forwarding a start signal DSST that is similarly supplied from outside.

Figure 2:
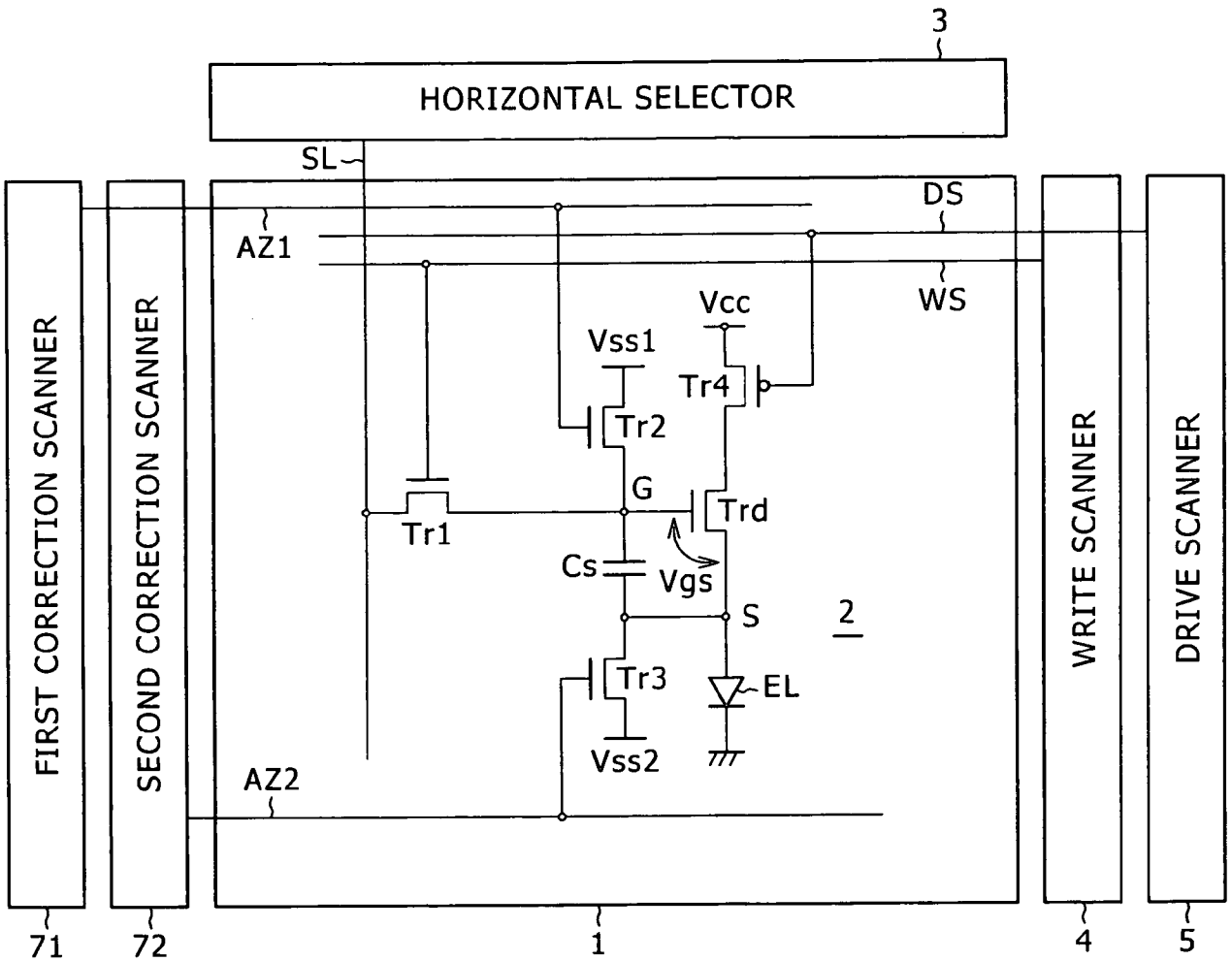
FIG. 2 is a circuit diagram indicating the pixel configuration of a display apparatus according to an embodiment of the present invention.

FIG. 2 is a circuit diagram indicating a configuration example of the pixel formed in the image display apparatus shown in FIG. 1. As shown in the diagram, the pixel circuit 2 includes a sampling transistor Tr1, a drive transistor Trd, a first switching transistor Tr2, a second switching transistor Tr3, a third switching transistor Tr4, a pixel capacitance Cs, and a light emitting element EL. The sampling transistor Tr1 becomes conductive in accordance with a control signal supplied from the scanning line WS during a predetermined sampling period, and samples the signal potential of the video signal supplied from the signal line SL to the pixel capacitance Cs. The pixel capacitance Cs applies an input voltage Vgs to a gate G of the drive transistor Trd in accordance with the signal potential of the video signal that has been sampled. The drive transistor Trd supplies an output current Ids corresponding to the input voltage Vgs to the light emitting element EL. The light emitting element EL emits light at a brightness corresponding to the signal potential of the video signal by way of the output current Ids that is supplied from the drive transistor Trd during a predetermined light emitting period.

The first switching transistor Tr2 becomes conductive in response to a control signal that is supplied from the scanning line AZ1 prior to the sampling period, and sets the gate G of the drive transistor Trd to the first potential Vss1. The second switching transistor Tr3 becomes conductive in response to a control signal that is supplied from the scanning line AZ2 prior to the sampling period, and sets a source S of the drive transistor Trd to the second potential Vss2. The third switching transistor Tr4 becomes conductive in accordance with a control signal that is supplied from the scanning line DS prior to the sampling period, and connects the drive transistor Trd to the third potential Vcc, and thus corrects the effects of a threshold voltage Vth by having a voltage corresponding to the threshold voltage Vth of the drive transistor Trd held by the pixel capacitance Cs. Further, this third switching transistor Tr4 becomes conductive in response to a control signal that is again supplied from the scanning line DS during the light emitting period, thereby connecting the drive transistor Trd to the third potential Vcc, and lets the output current Ids flow to the light emitting element EL.

As can be seen from the description above, the pixel circuit 2 includes the five transistors Tr1 to Tr4 and Trd, the one pixel capacitance Cs, and one light emitting element EL. The transistors Tr1 to Tr3 and Trd are N-channel type polysilicon TFTs. Only the transistor Tr4 is a P-channel type polysilicon TFT. However, the present invention is not limited thereto, and it is possible to use an appropriate mix of N-channel type TFTs and P-channel type TFTs. The light emitting element EL is, for example, an organic EL device of a diode type that is equipped with an anode and a cathode. However, the present invention is not limited thereto, and the light emitting element here may include all devices in general that are driven by a current to emit light.

Figure 3:
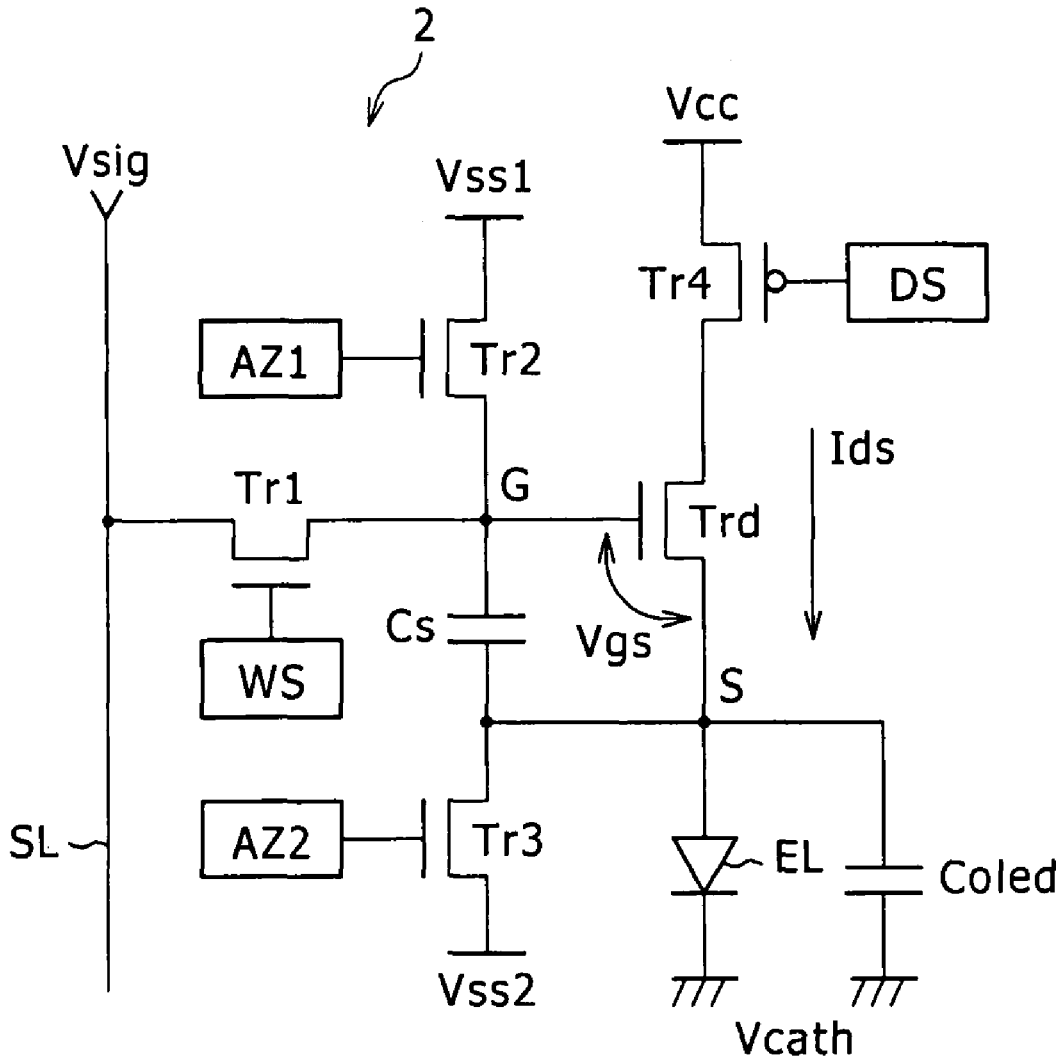
FIG. 3 is a schematic diagram that aids in explaining the operations of a display apparatus according to an embodiment of the present invention.

FIG. 3 is a schematic diagram in which only the pixel circuit 2 portion is taken out from the image display apparatus shown in FIG. 2. In order to facilitate an easier understanding, a signal potential Vsig of the video signal sampled by the sampling transistor Tr1, the input voltage Vgs and the output current Ids of the drive transistor Trd, a capacitance component Coled that the light emitting element EL has, and the like are additionally written in. Operations of the pixel circuit 2 according to an embodiment of the present invention will be described based on FIG. 3.

Figure 4:
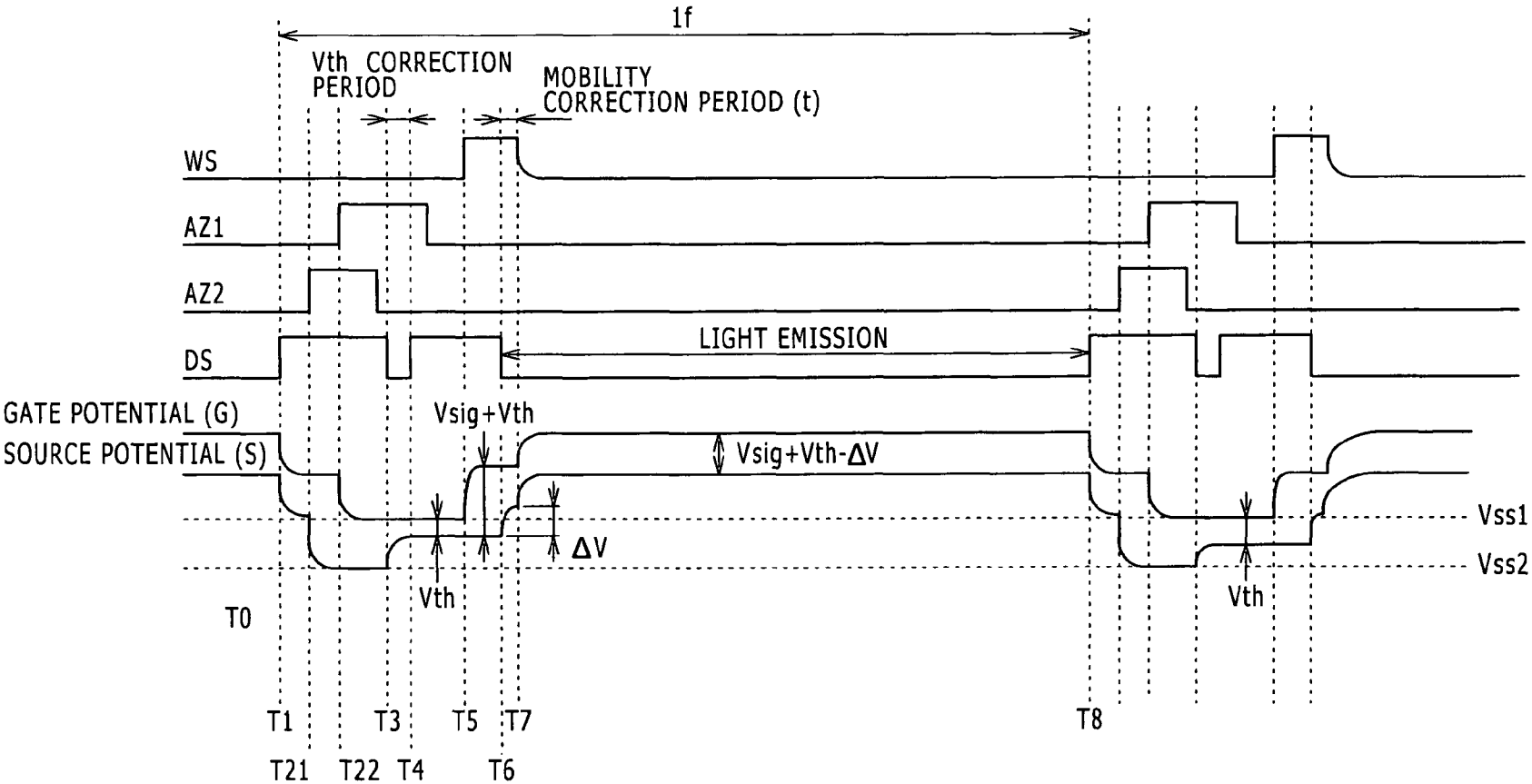
FIG. 4 is a timing chart that aids in explaining the operations of a display apparatus according to an embodiment of the present invention.

FIG. 4 is a timing chart for the pixel circuit shown in FIG. 3. With reference to FIG. 4, operations of the pixel circuit according to an embodiment of the present invention shown in FIG. 3 will be described in detail. Along a time axis T, FIG. 4 indicates the waveforms of the control signals applied to each of the scanning lines WS, AZ1, AZ2 and DS. In order to simplify the representation, the control signals are indicated with the same reference symbols as those of the corresponding scanning lines. Since the transistors Tr1, Tr2, and Tr3 are of a N-channel type, they turn on when the scanning lines WS, AZ1, and AZ2, respectively, are at high levels, and turn off when they are at low levels. On the other hand, since the transistor Tr4 is a P-channel type, it turns off when the scanning line DS is at a high level and turns on when the scanning line DS is at a low level. It is noted that this timing chart shows, along with the waveforms of each of the control signals WS, AZ1, AZ2 and DS, changes in the potential of the gate G, as well as of the source S, of the drive transistor Trd.

For the timing chart in FIG. 4, timings T1 to T8 are taken to be one field (1*f*). During one field, each row of the pixel array is sequentially scanned once. This timing chart indicates the waveforms of each of the control signals WS, AZ1, AZ2 and DS that are applied to a row of pixels.

At the timing T0 before the field begins, all of the control signals WS, AZ1, AZ2, and DS are at low levels. Therefore, while the N-channel type transistors Tr1, Tr2, and Tr3 are in an OFF state, the P-channel type transistor Tr4 alone is in an ON state. Therefore, since the drive transistor Trd is connected to the power source Vcc via the transistor Tr4, which is in an ON state, the drive transistor Trd supplies the output current Ids corresponding to the predetermined input voltage Vgs to the light emitting element EL. Thus, at timing T0, the light emitting element EL is emitting light. Here, the input voltage Vgs that is applied to the drive transistor Trd can be expressed as the difference between the gate potential (G) and the source potential (S).

At the timing T1 at which the field begins, the control signal Ds switches from a low level to a high level. As a result, the transistor Tr4 turns off, the drive transistor Trd is cut off from the power source Vcc, and the emission of light is terminated, and thus a non-light emitting period begins. Therefore, upon entering the timing T1, all of the transistors Tr1 to Tr4 enter an OFF state.

Following the timing T1, the control signal AZ2 rises at a timing T21, and the switching transistor Tr3 turns on. As a result, the source (S) of the drive transistor Trd is initialized to the predetermined potential Vss2. Subsequently, at a timing T22, the control signal AZ1 rises, and the switching transistor Tr2 turns on. As a result, the gate potential (G) of the drive transistor Trd is initialized to the predetermined potential Vss1. As a result, the gate G of the drive transistor Trd is connected to the reference potential Vss1, and the source S is connected to the reference potential Vss2. Here, the condition Vss1−Vss1>Vth is satisfied, and the Vth correction that is performed thereafter at the timing T3 is prepared by satisfying Vss1−Vss2=Vgs>Vth. In other words, the period between T21−T3 corresponds to a resetting period for the drive transistor Trd. In addition, assuming that the threshold voltage of the light emitting element EL is VthEL, VthEL is set to be greater than Vss2. As a result, a negative bias is applied to the light emitting element EL, and the light emitting element EL is turned in a so-called reverse bias state. This reverse bias state is necessary in order to properly perform the Vth correction operation and mobility correction operation which is performed later on.

At the timing T3, after the control signal AZ2 is lowered to a low level, the control signal Ds is lowered to a low level. Thus, while the transistor Tr3 turns off, the transistor Tr4 turns on. As a result, a drain current Ids flows into the pixel capacitance Cs, and the Vth correction operation is initiated. At this point, the gate G of the drive transistor Trd is held at Vss1, and the current Ids flows until the drive transistor Trd cuts off. Once the drive transistor Trd cuts off, the source potential (S) of the drive transistor Trd becomes Vss1−Vth. At the timing T4, which is after the drain current is cut off, the control signal Ds is returned again to a high level, and the switching transistor Tr4 is turned off. Further, the control signal AZ1 also is returned to a low level, thereby turning off the switching transistor Tr2. As a result, Vth is held and fixed at the pixel capacitance Cs. As described above, the period between timing T3 and timing T4 is a period for detecting the threshold voltage Vth of the drive transistor Trd. Hereinafter, this detection period T3−T4 will be referred to as the Vth correction period.

After the Vth correction is performed as described above, the control signal WS is switched to a high level at the timing T5 to turn the sampling transistor Tr1 on, and the signal potential Vsig of the video signal is written in the pixel capacitance Cs. The pixel capacitance Cs is sufficiently small compared to an equivalent capacitance Coled of the light emitting element EL. As a result, a substantial majority of the signal potential Vsig of the video signal is written in the pixel capacitance Cs. More precisely, the difference of Vsig with reference to Vss1, which is Vsig−Vss1, is written in the pixel capacitance Cs. Therefore, the voltage Vgs between the gate G and the source S of the drive transistor Trd is at a level where Vth, which is detected and held in advance, and Vsig−Vss1, which is sampled as described directly above, are added together (in other words, Vsig−Vss1+Vth). For purposes of simplicity, if it is assumed that Vss1=0V, the voltage Vgs between the gate and the source is, as indicated in the timing chart in FIG. 4, Vsig+Vth. The sampling of the signal potential Vsig of the video signal is continued up to timing the T7 at which the control signal WS returns to a low level. In other words, the period between T5 and T7 corresponds to a sampling period.

At the timing T6, which comes before the timing T7 at which the sampling period terminates, the control signal DS becomes low level, and the switching transistor Tr4 turns on. Thus, the drive transistor Trd is connected to the power source Vcc, and the pixel circuit proceeds from a non-light emitting period to a light-emitting period. During the period T6−T7, in which the sampling transistor Tr1 is still in an ON state and in which the switching transistor Tr4 has entered an ON state as described above, the mobility correction for the drive transistor Trd is performed. In other words, in the present embodiment, mobility correction is performed the during period T6−T7 in which the latter part of the sampling period and the beginning part of the light emitting period overlap. It is noted that in the beginning of the light emitting period during which mobility correction is performed, the light emitting element EL is in fact in a reverse bias state, and therefore does not emit light. During this mobility correction period T6–T7, the drain current Ids flows to the drive transistor Trd in a state where the gate G of the drive transistor Trd is fixed at the level of the signal potential Vsig of the video signal. Here, by setting Vss1–Vth to be less than VthEL in advance, the light emitting element EL is placed in a reverse bias state, and exhibits simple capacitive characteristics and not diode characteristics. Thus, the current Ids that flows to the drive transistor Trd is written in a capacitance C=Cs+Coled, which is the combination of pixel capacitance Cs and the equivalent capacitance Coled of the light emitting element EL. As a result, the source potential (S) of the drive transistor Trd rises. In the timing chart of FIG. 4, this rise is expressed as ΔV. Since this rise ΔV is eventually subtracted from the voltage Vgs between the gate and the source that is held by the pixel capacitance Cs, it means a negative feedback is applied. By negatively feeding back the output current Ids of the drive transistor Trd to the input voltage Vgs of the drive transistor Trd as described above, it is possible to correct mobility μ. It is noted that by adjusting the time width t of the mobility correction period T6–T7, the negative feedback amount ΔV can be optimized. In the present embodiment, a gradient is given to the trailing end of the control signal WS.

At the timing T7, the control signal WS is at a low level, and the sampling transistor Tr1 turns off. As a result, the gate G of the drive transistor Trd is cut off from the signal line SL. Since the application of the signal potential Vsig of the video signal is terminated, the gate potential (G) of the drive transistor Trd is now able to rise, and it rises along with the source potential (S). Meanwhile, the voltage Vgs between the gate and the source that is held by the pixel capacitance Cs maintains the value of (Vsig−ΔV+Vth). As the source potential (S) rises, the reverse bias state of the light emitting element EL is resolved, thereby allowing the output current Ids to flow in such that the light emitting element EL begins to actually emit light. At this point, the relationship between the drain current Ids and the gate voltage Vgs can be expressed by Equation 2 below by substituting Vsig−ΔV+Vth for Vgs in equation 1 mentioned above.

$$Ids=k\mu(Vgs-Vth)^2=k\mu(Vsig-\Delta V)2 \qquad \text{Equation 2}$$

In Equation 2 above, k=(1/2)(W/L)Cox. From Equation 2, it can be seen that the term Vth is cancelled and the output current Ids supplied to the light emitting element EL is not dependent on the threshold voltage Vth of the drive transistor Trd. Basically, the drain current Ids is determined by the signal potential Vsig of the video signal. In other words, the light emitting element EL emits light at a brightness that corresponds to the signal potential Vsig of the video signal. In so doing, Vsig is corrected by the negative feedback amount ΔV. This correction amount ΔV works to just cancel the effect of mobility μ that is positioned at the coefficient part in Equation 2. Therefore, the drain current Ids is in effect dependent only on the signal potential Vsig of the video signal.

Finally, at the timing T8, the control signal DS becomes a high level, the switching transistor Tr4 turns off, the emission of light is terminated, and the field comes to an end. Thereafter, the next field begins, and the Vth correction operation, the sampling operation for the signal potential, the mobility correction operation and the light emission operation are repeated.

Figure 5:
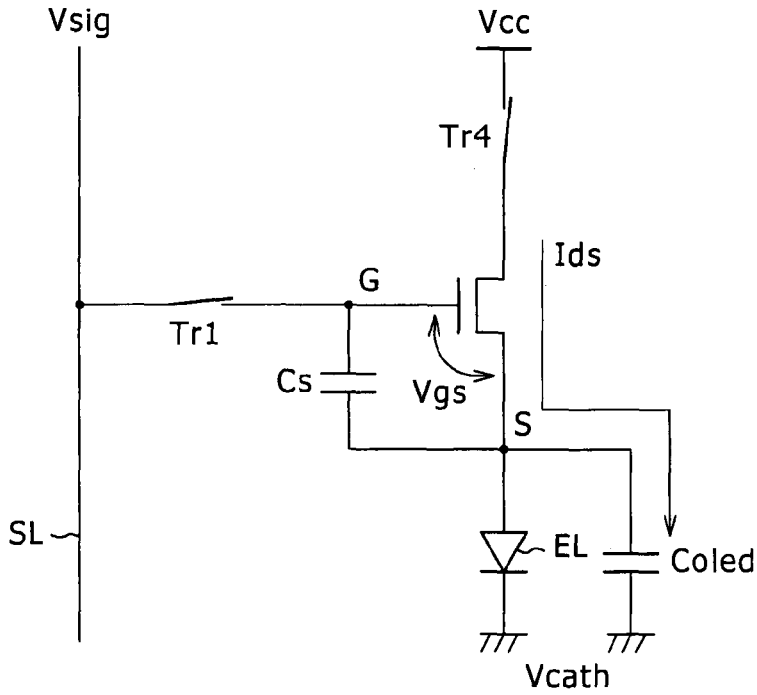
FIG. 5 is a schematic circuit diagram that aids in explaining the operations of a display apparatus according to an embodiment of the present invention.

FIG. 5 is a circuit diagram indicating the state of the pixel circuit 2 during the mobility correction period T6–T7. As shown in the diagram, during the mobility correction period T6–T7, while the sampling transistor Tr1 and the switching transistor Tr4 are ON, the remaining switching transistors Tr2 and Tr3 are OFF. In this state, the source potential (S) of the drive transistor Tr4 is Vss1–Vth. This source potential (S) also happens to be the anode potential of the light emitting element EL. As described above, by setting Vss1–Vth to be less than VthEL in advance, the light emitting element EL is placed in a reverse bias state, and exhibits simple capacitive characteristics and not diode characteristics. Therefore, the current Ids that flows to the drive transistor Trd flows into a capacitance C=Cs+Coled, which is the combination of the pixel capacitance Cs and the equivalent capacitance Coled of the light emitting element EL. In other words, a portion of the drain current Ids is negatively fed back to the pixel capacitance Cs to correct the mobility.

Figure 6:
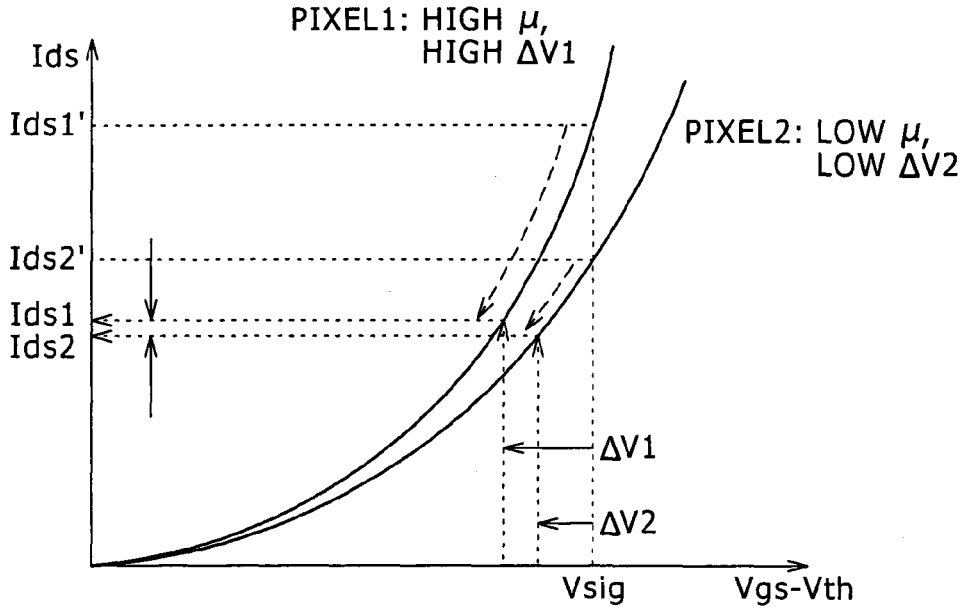
FIG. 6 is a graph that aids in explaining the operations of a display apparatus according to an embodiment of the present invention.

FIG. 6 is a diagram in which Equation 2 mentioned above is expressed as a graph, and the vertical axis represents Ids and the horizontal axis represents Vsig. Equation 2 also is indicated in the lower portion of the graph. The graph in FIG. 6 shows characteristic curves and compares pixel 1 and pixel 2. The mobility μ of the drive transistor of the pixel 1 is relatively large. On the contrary, the mobility μ of the drive transistor included in the pixel 2 is relatively small. When a polysilicon thin film transistor is used for the drive transistor as described above, it is inevitable that the mobility μ would vary from pixel to pixel. For example, when the signal potential Vsig of video signals of the same level are written in both pixels 1 and 2, if no mobility correction is performed, there would arise a great difference between an output current Ids 1' that flows to the pixel 1, whose mobility μ is large, and an output current Ids 2' that flows to the pixel 2, whose mobility μ is small. Thus, since large differences between the output currents Ids occur as a result of variations in mobility μ, uneven streaks occur, and the uniformity of the screen is compromised.

As such, with the present invention, variations in mobility are cancelled by negatively feeding back the output current to the input voltage side. As can be seen from Equation 1 above, when mobility is large, the drain current Ids becomes greater. Therefore, the negative feedback amount ΔV is greater the greater the mobility is. As indicated in the graph in FIG. 6, a negative feedback amount ΔV1 of the pixel 1, whose mobility μ is large, is greater as compared to a negative feedback amount ΔV2 of the pixel 2, whose mobility μ is small. Thus, variations can be suppressed since the negative feedback becomes greater the greater the mobility μ is. As shown in the diagram, when a correction of ΔV1 is performed for the pixel 1, whose mobility μ is large, the output current drops significantly from Ids 1' to Ids 1. On the other hand, since the correction amount ΔV2 of the pixel 2, whose mobility μ is small, is small, the output current drops from Ids 2' to Ids 2, which is not as much. As a result, Ids 1 and Ids 2 become similar in value, and variations in mobility are cancelled. Since this cancellation of variations in mobility is performed for the entire range of Vsig from the black level to the white level, the uniformity of the screen becomes significantly high. Summing up the description above, when there are two pixels 1 and 2, whose mobilities are different, the correction amount ΔV1 of the pixel 1, whose mobility is large, becomes small in relation to the correction amount ΔV2 of the pixel 2, whose mobility is small. In other words, the greater the mobility is, the greater ΔV is, and thus the amount by which Ids decreases becomes greater. As a result, the current values for pixels with differing mobilities are equalized, and thus it becomes possible to correct variations in mobility.

Hereinafter, for reference, a numerical analysis of the mobility correction will be given. As shown in FIG. 5, an analysis will be performed with the transistors Tr1 and Tr4 in an ON state and with the source potential of the drive transistor Trd taken to be variable V. Assuming that the source potential (S) of the drive transistor Trd is V, the drain current Ids flowing to the drive transistor Trd is expressed by Equation 3 below.

$$Ids==k\mu(V_{gs}-V_{th})^2=k\mu(V_{sig}-V-V_{th})^2 \quad \text{Equation 3}$$

In addition, based on the relationship between the drain current Ids and the capacitance C (=Cs+Coled), Ids=dQ/dt=CdV/dt holds true, as indicated by Equation 4 below.

$$I_{ds}=\frac{dQ}{dt}=C\frac{dV}{dt}\text{THEN}\int\frac{1}{C}dt=\int\frac{1}{I_{ds}}dV \Leftrightarrow \quad \text{Equation 4}$$

$$\int_0^t\frac{1}{C}dt=\int_{-Vth}^{V}\frac{1}{k\mu(V_{sig}-V_{th}-V)^2}dV \Leftrightarrow$$

$$\frac{k\mu}{C}t=\left[\frac{1}{V_{sig}-V_{th}-V}\right]_{-Vth}^{V}$$

$$=\frac{1}{V_{sig}-V_{th}-V}-\frac{1}{V_{sig}} \Leftrightarrow$$

$$V_{sig}-V_{th}-V$$

$$=\frac{1}{\frac{1}{V_{sig}}+\frac{k\mu}{C}t}$$

$$=\frac{V_{sig}}{1+V_{sig}\frac{k\mu}{C}t}$$

Equation 3 is substituted into equation 4, and both sides are integrated. Here, the initial state of the source voltage V is −Vth, and the mobility variation correction time (T6−T7) is t. Solving this differential equation, the pixel current with respect to the mobility correction time t is given by Equation 5 below.

$$I_{ds}=k\mu\left(\frac{V_{sig}}{1+V_{sig}\frac{k\mu}{C}t}\right)^2 \quad \text{Equation 5}$$

Figure 7:
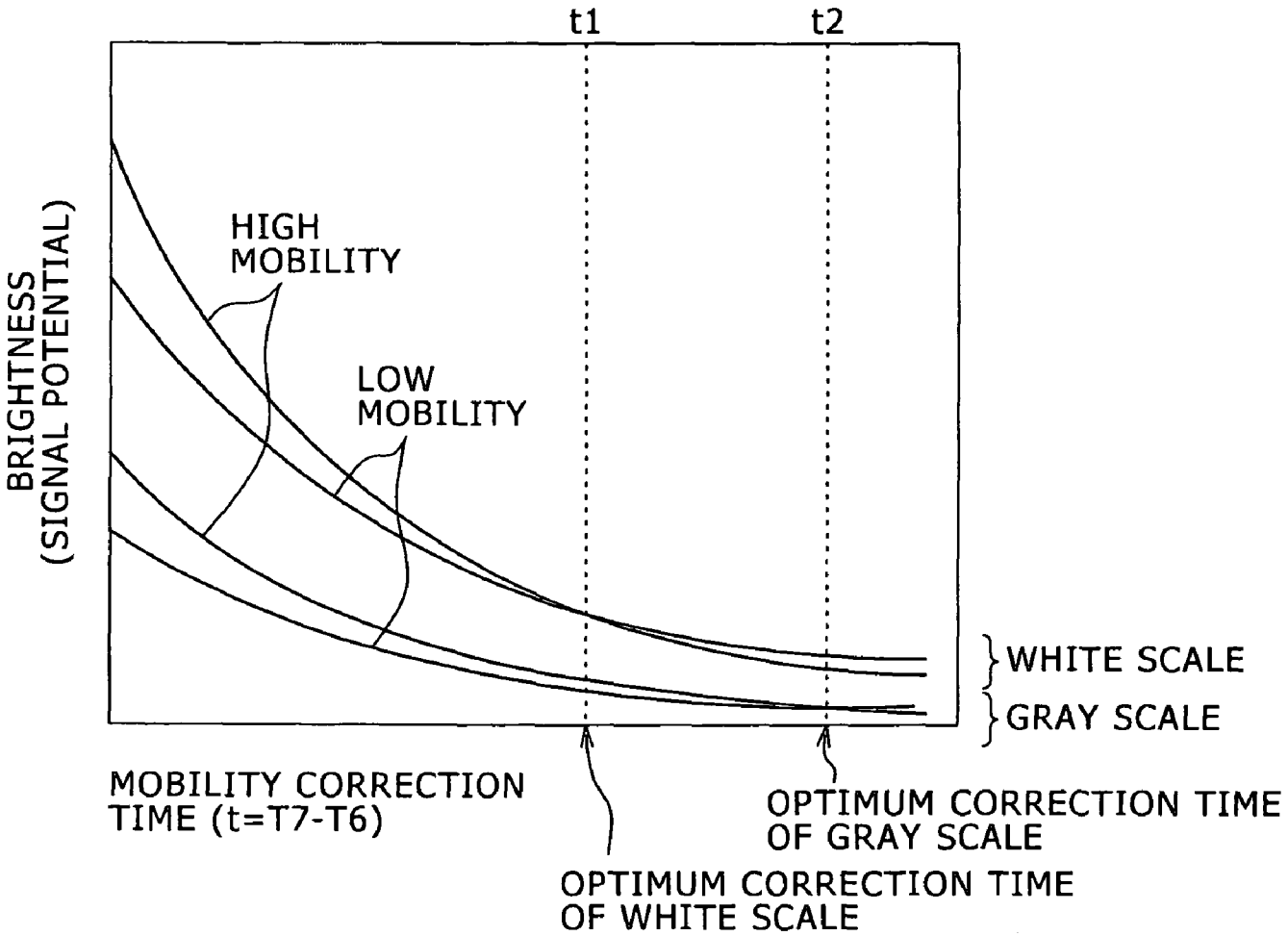
FIG. 7 is a graph that aids in explaining the operations of a display apparatus according to an embodiment of the present invention.

It is noted that the optimum mobility correction time t tends to differ depending on the brightness level of the pixel (the signal potential Vsig of the video signal). This point will be explained with reference to FIG. 7. In the graph of FIG. 7, the horizontal axis represents the mobility correction time t (T7−T6), and the vertical axis represents the brightness (signal potential). At a high brightness (white scale), the brightness level becomes comparable between a high mobility drive transistor and a low mobility drive transistor when the mobility correction time is at t1. In other words, when the input signal potential is of a white scale, the mobility correction time t1 is the optimum correction time. On the other hand, when the signal potential is at a medium brightness (gray scale), there is a difference in brightness at the mobility correction time t1 between the high mobility transistor and the low mobility transistor, and a perfect correction cannot be performed. When a correction period t2 that is longer than t1 is secured, the brightness level becomes comparable between the high mobility transistor and the low mobility transistor. Therefore, when the signal potential is of a gray scale, the optimum correction time t2 is longer than the optimum correction time t1 for the white scale.

If the mobility correction time t is fixed regardless of the brightness level, it becomes difficult to perform mobility correction perfectly at all scales, and uneven streaks occur. For example, if the mobility correction time t is fixed at t1, which is the optimum correction time for white scales, streaks remain on the screen when the input video signal is a gray scale. On the contrary, if the mobility correction time is fixed at t2, which is the optimum correction time for gray scales, uneven streaks appear on the screen when the video signal is a white scale. In other words, if the mobility correction time t is fixed, variations in mobility cannot be corrected for all scales ranging from white scale to gray scale.

Figure 8:
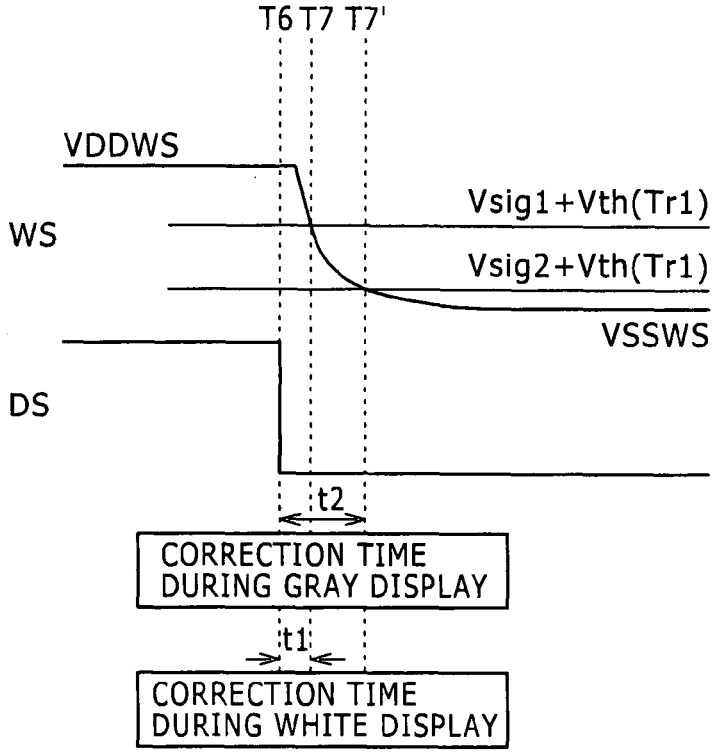
FIG. 8 is a waveform chart that aids in explaining the operations of a display apparatus according to an embodiment of the present invention.

As such, with an embodiment of the present invention, the mobility correction period t is made automatically adjustable so as to be optimized in accordance with the level of the signal potential Vsig of the input video signal. This point will be described in detail with reference to FIG. 8. FIG. 8 indicates, along a time axis, the trailing waveform of the control signal DS that is applied to the gate of the switching transistor Tr4 and the trailing waveform of the control signal WS that is applied to the gate of the sampling transistor Tr1. In the present embodiment, since the switching transistor Tr4 is a P-channel type, the transistor Tr4 turns on at the point where the control signal DS falls (T6). As described above, this timing T6 is the point at which the mobility correction period t begins.

On the other hand, the control signal WS is applied to the gate of the sampling transistor Tr1. As described above, since the sampling transistor Tr1 is a N-channel type in the present embodiment, the sampling transistor Tr1 turns off at timing T7 or T7' when the control signal WS falls, thereby terminating the mobility correction period.

The write scanner 4 has an output section that gives a gradient to the trailing end of the control signal WS which governs the termination of the mobility correction period t. This output section optimizes the correction period t for both a case where the signal potential is high (Vsig1) as well as a case where the signal potential is low (Vsig2) by outputting a curved gradient waveform, where the gradient is initially made steep and then made more gentle, to each of the scanning lines WS.

The curved gradient waveform of the control signal WS indicated in FIG. 8 is applied to the gate of the sampling transistor Tr1 via the corresponding scanning line WS. On the other hand, the signal potential Vsig is applied to the source of the sampling transistor Tr1 via the signal line SL. Assuming that the gate voltage of the sampling transistor Tr1 is Vth (Tr1), if the gate potential drops to the threshold voltage Vth (Tr1) with the source potential as a reference, the channel enters an OFF state. When the signal potential is at a high level Vsig1 during a white display, the sampling transistor Tr1 turns off when the trailing waveform of the control signal WS crosses Vsig1+Vth (Tr1) in the stage where the trailing waveform drops from the high level of VDDWS to the low level of VSSWS. Here, the trailing waveform of the control signal WS is a curved gradient waveform and crosses the level of Vsig1+Vth (Tr1) right at the portion where it is steep. As a result, the correction time t1 during white display is T7−T6 and is relatively short.

On the other hand, during a gray display, the signal potential is at a relatively low level of Vsig2. Since the trailing waveform of the control signal WS crosses the level of Vsig2+Vth (Tr1) at a portion where its gradient is moderate as shown in the diagram, the correction period t2 during a gray display is T7'−T6 and is relatively long. Further, during a black display, the signal potential becomes lower than Vsig2, timing T7' shifts further backward, and the correction time during the black display becomes even longer.

Figure 9:
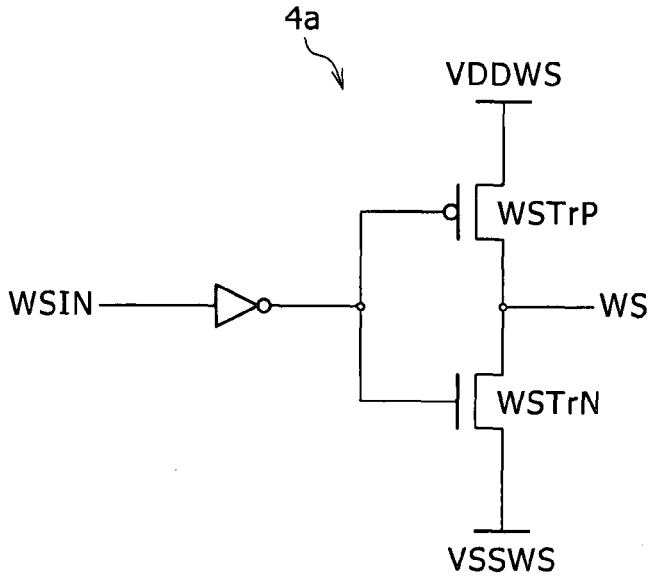
FIG. 9 is a circuit diagram indicating a first embodiment of a display apparatus according to an embodiment of the present invention.

FIG. 9 is a schematic circuit diagram that indicates a first embodiment of an output section 4*a* incorporated in the write scanner 4. As shown in the diagram, this output section 4*a* is equipped with an output buffer of an inverter configuration. This output buffer includes a P-channel type transistor WSTrP and an N-channel type transistor WSTrN that are connected in series, and the output buffers is connected in series between a power source potential VDDWS and an earth potential VSSWS of the scanner 4. An input signal WSIN is applied to an output inverter of a subsequent stage via an inverter of a preceding stage, and is outputted as the control signal WS. It is noted that the input signal WSIN is generated by the write scanner 4 in conjunction with the sequential line scanning. More specifically, the write scanner 4 includes a shift register, and generates the input signal WSIN for each line of the scanning lines WS by operating in accordance with a clock signal WSCK that is inputted from outside and sequentially forwarding a start signal WSST that is similarly inputted from outside.

Figure 10:
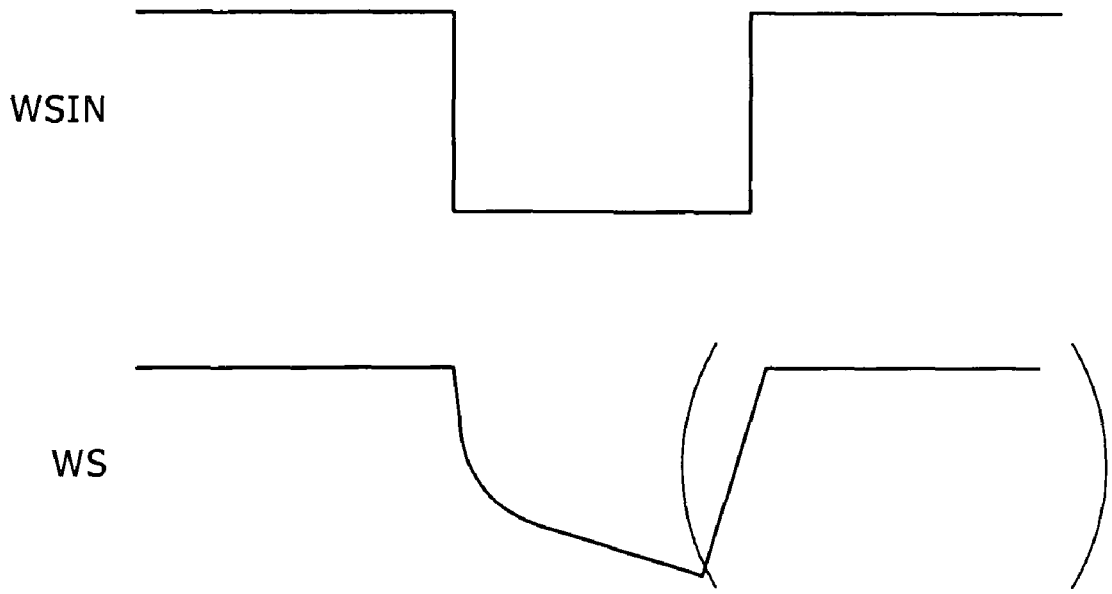
FIG. 10 is a waveform chart that aids in explaining the operations of the first embodiment.

FIG. 10 indicates the input signal WSIN that is inputted to the output section 4*a* and the control signal WS that is outputted from the output section 4*a*. The output section 4*a* in FIG. 9 outputs the control signal WS having a curved gradient waveform by blunting the input signal WSIN having a rectangular waveform. It is noted that since the rising waveform of the control signal WS is actually unnecessary, it is masked at the output section 4*a*. The output section 4*a* shown in FIG. 9 blunts the input signal WSIN having a rectangular waveform as shown in FIG. 10 by utilizing the operations of the P-channel transistor WSTrP included in the inverter configuration of the output buffer. Alternatively, the input signal WSIN having a rectangular waveform may be modified by making the size factor (W/L) of the transistors WSTrP and WSTrN included in the inverter configuration of the output buffer smaller than the size factor of the other transistors making up the write scanner 4. Further, the trailing waveform outputted from the output buffer may be further modified to the curved gradient waveform shown in the diagram by utilizing the time constant that is determined by the wiring resistance R and the wiring capacitance C of the scanning line WS. It is noted that the size factor (W/L) represents the current supply capability of the transistor, and the greater the channel width W is, the higher its drive performance is, and its ON resistance is low. On the other hand, a shorter channel length L means a higher drive performance, and the ON resistance is low.

As described above, in the first embodiment, as a method of blunting the final stage output waveform of the write scanner, a P-channel transistor, such as a PMOS, is used for the final stage buffer of the write scanner 4. Alternatively, the size factor (W/L) of the final stage buffer of the write scanner 4 is made small. Further, the wiring resistance R and the wiring capacitance C between the final stage of the write scanner 4 and the pixel input end may be made high. When a PMOS is used for the final stage buffer of the write scanner 4 as shown in FIG. 9, the PMOS itself operates in such a manner that when the power source voltage is high, the ON resistance of the transistor is small and the trailing speed is fast, and on the contrary, when the power source voltage is low, it operates in such a manner that the ON resistance of the transistor is large and the trailing speed is slow. Therefore, by utilizing such operating characteristics of the PMOS itself, a curved gradient waveform can be created easily, and the mobility correction period t can be made short for a white scale and long for a gray scale. In addition, if the size factor (W/L) of the final stage buffer of the write scanner 4 is made small, the ON resistance becomes greater accordingly, and it is possible to obtain a curved gradient waveform for the control signal WS by greatly blunting the input signal WSIN. Further, by varying the extent of modification for the waveform of the control signal WS, in other words a wiring time constant CR, the mobility correction period t for each scale can be adjusted. Thus, for example, the optimum mobility correction period t1 at a white scale may be made to be 1 μs, while the optimum mobility correction time t2 for a gray scale may be made to be 5 μs. By such methods, the mobility correction period t for each scale can be optimized, and uneven streaks in the image, which were issues with related art technology, may be eliminated.

Figure 11:
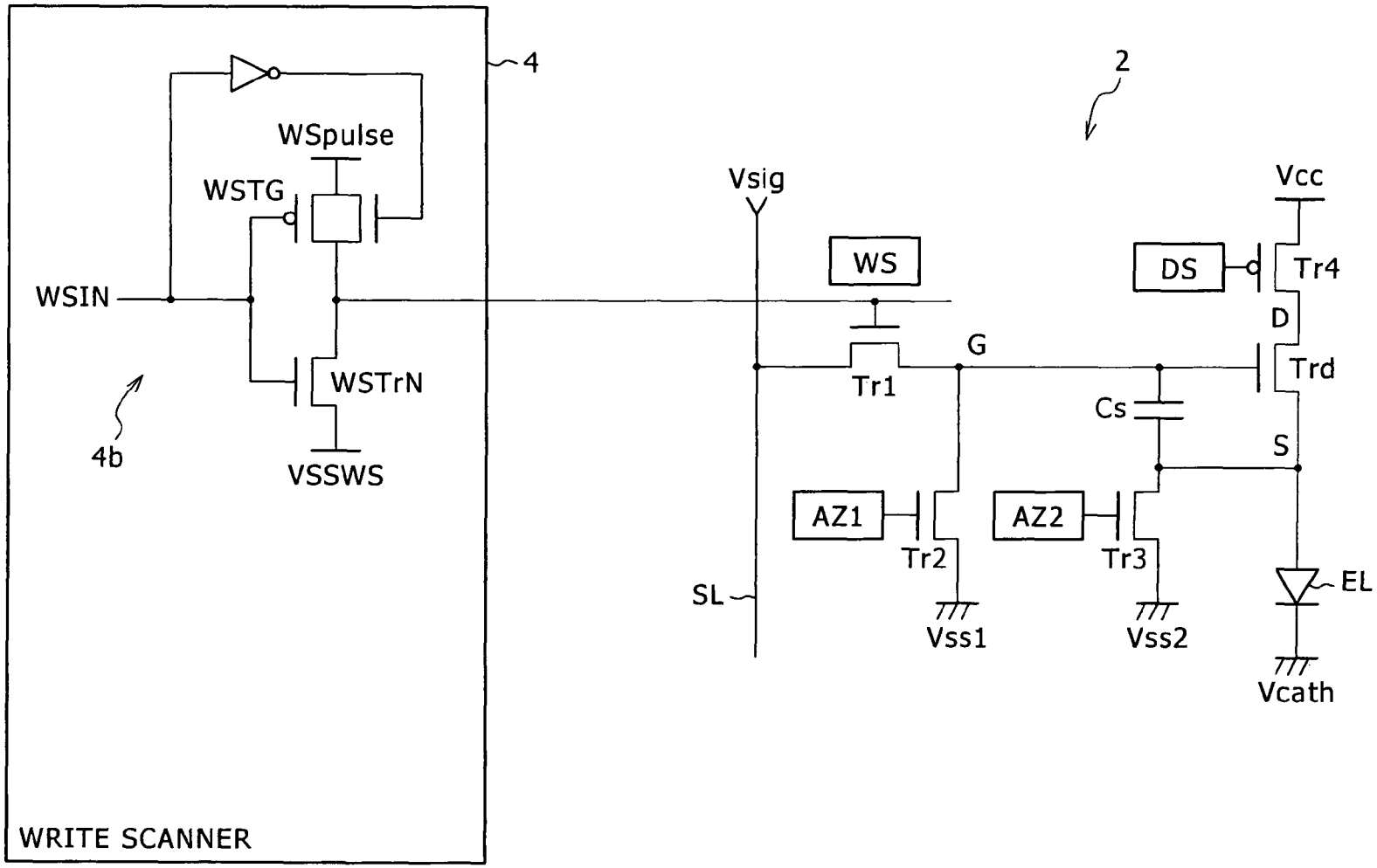
FIG. 11 is a circuit diagram indicating a second embodiment of a display apparatus according to the present invention.

FIG. 11 is a schematic circuit diagram indicating a second embodiment of the output section of the write scanner 4. In order to facilitate an easier understanding, in the diagram, an output section 4*b* of the write scanner 4 is shown with only one stage of its corresponding scanning line WS. As shown in the diagram, this output section 4*b* is connected to the gate of the sampling transistor Tr1 included in the pixel circuit 2 via the scanning line WS. This output section 4*b* is provided between the power line and the earth line VSSWS, and is equipped with an output buffer that includes a transmission gate WSTG. When the transmission gate WSTG opens in accordance with the input signal WSIN, a power source pulse WSpulse supplied to the power line is extracted and is outputted to the scanning line WS as the control signal WS. With the first embodiment shown in FIG. 9, a curved gradient waveform is obtained by blunting the input signal utilizing the ON resistance of the output buffer. However, since the ON resistance of the output buffer varies per each stage, there are cases where precise mobility correction time control cannot be performed. As opposed thereto, the present embodiment supplies the power source pulse WSpulse that is externally generated with precision in advance and that has a curved gradient waveform to the buffer, extracts the curved gradient waveform as it is from the power source pulse WSpulse at the transmission gate WSTG, and makes it the control signal WS. The transmission gate WSTG is a CMOS transistor, has a low ON resistance, and is capable of outputting the curved gradient waveform included in the power source pulse WSpulse as it is with almost no loss to the scanning line WS side.

Figure 12:
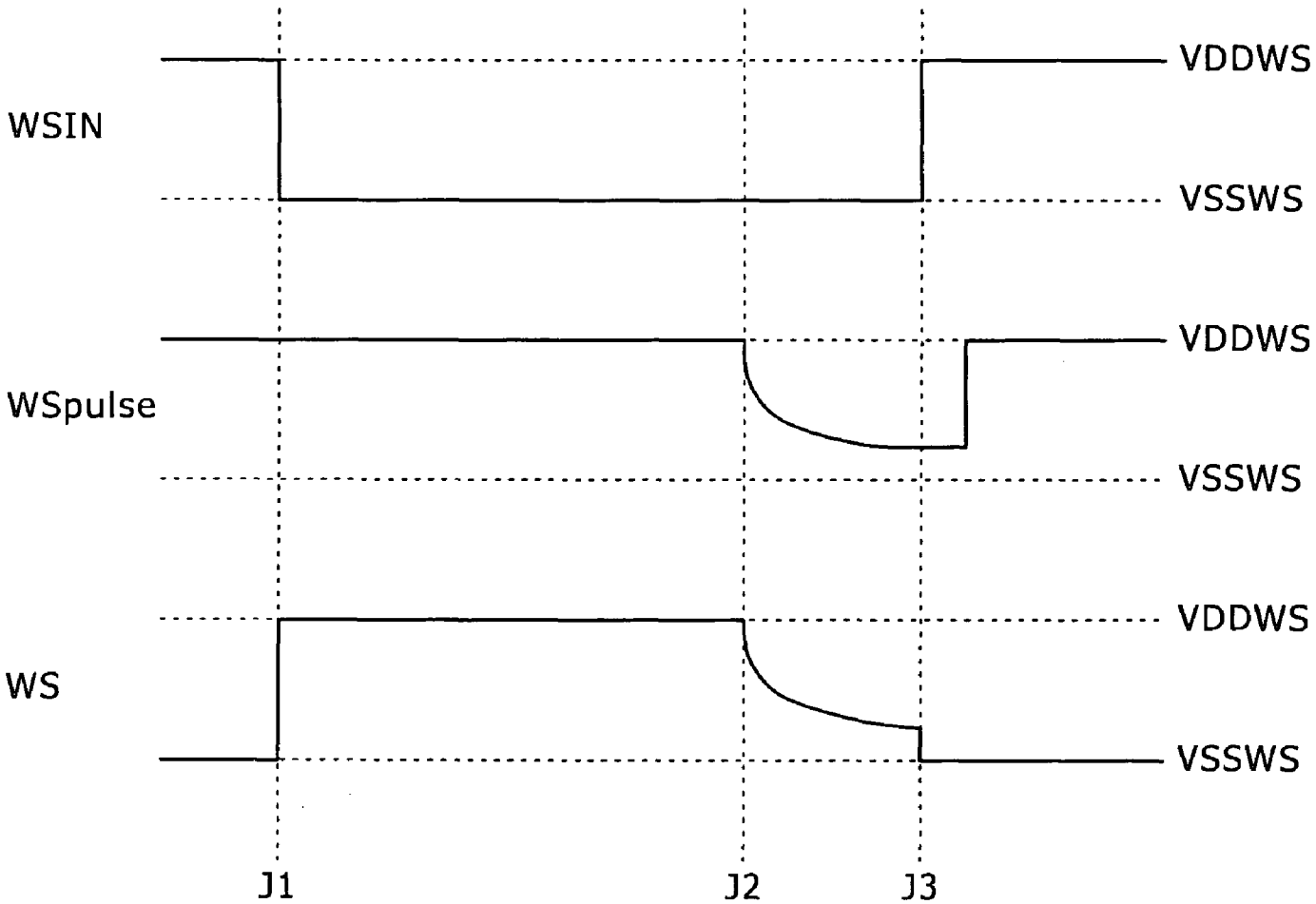
FIG. 12 is a timing chart that aids in explaining the operations of the second embodiment.

FIG. 12 is a timing chart that aids in explaining the operations of the output section 4*b* according to the second embodiment shown in FIG. 11. The input signal WSIN is sequentially outputted per each stage from the shift register making up the write scanner 4 in conjunction with the sequential line scanning. It is noted that the write scanner 4 is ordinarily provided on the same panel as the pixel array. On the other hand, the power source pulse WSpulse is generated at a discrete circuit that is an external section of the panel, and is supplied to the power line of the write scanner 4. This power source pulse WSpulse is synchronized with the input signal WSIN in advance so as to maintain the phase relationship shown in the diagram.

First, at a timing J1, the input signal WSIN falls from VDDWS to VSSWS, and the transmission gate WSTG turns on. As a result, the power level VDDWS of the power source pulse WSpulse is taken in, and the output control signal WS rises from VSSWS to VDDWS. Then, while the transmission gate WSTG is still ON, the power source pulse WSpulse falls. Therefore, the curved gradient waveform of this trailing portion passes through the transmission gate WSTG as it is and forms the trailing waveform of the output control signal WS. In other words, the control signal WS initially falls rapidly from a timing J2 and then declines gently thereafter. Finally, at a timing J3, the input signal WSIN returns to the high level of VDDWS from the low level of WSSWS, the transmission gate WSTG turns off, and the control signal WS is at the level of VSSWS.

Figure 13:
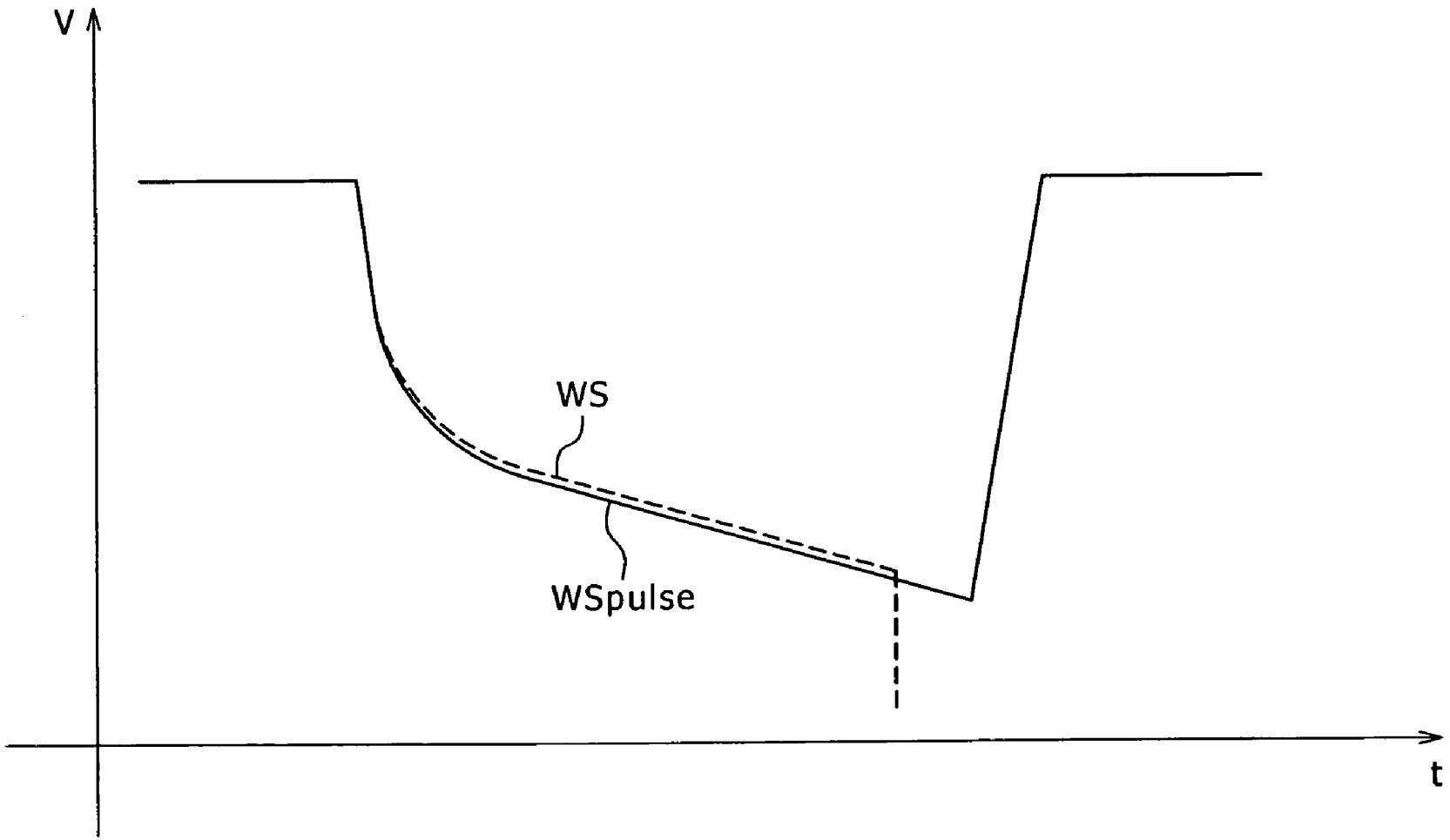
FIG. 13 is a waveform chart that aids in explaining the operations of the second embodiment.

FIG. 13 shows the power source pulse WSpulse supplied to the output section 4*b* shown in FIG. 11 superimposed on the waveform of the control signal WS that is outputted therefrom. As shown in the diagram, since the output section 4*b* uses a transmission gate element for its output buffer, the curved gradient waveform of the power source pulse WSpulse becomes the curved gradient waveform of the control signal WS without being altered in any way.

Figure 14:
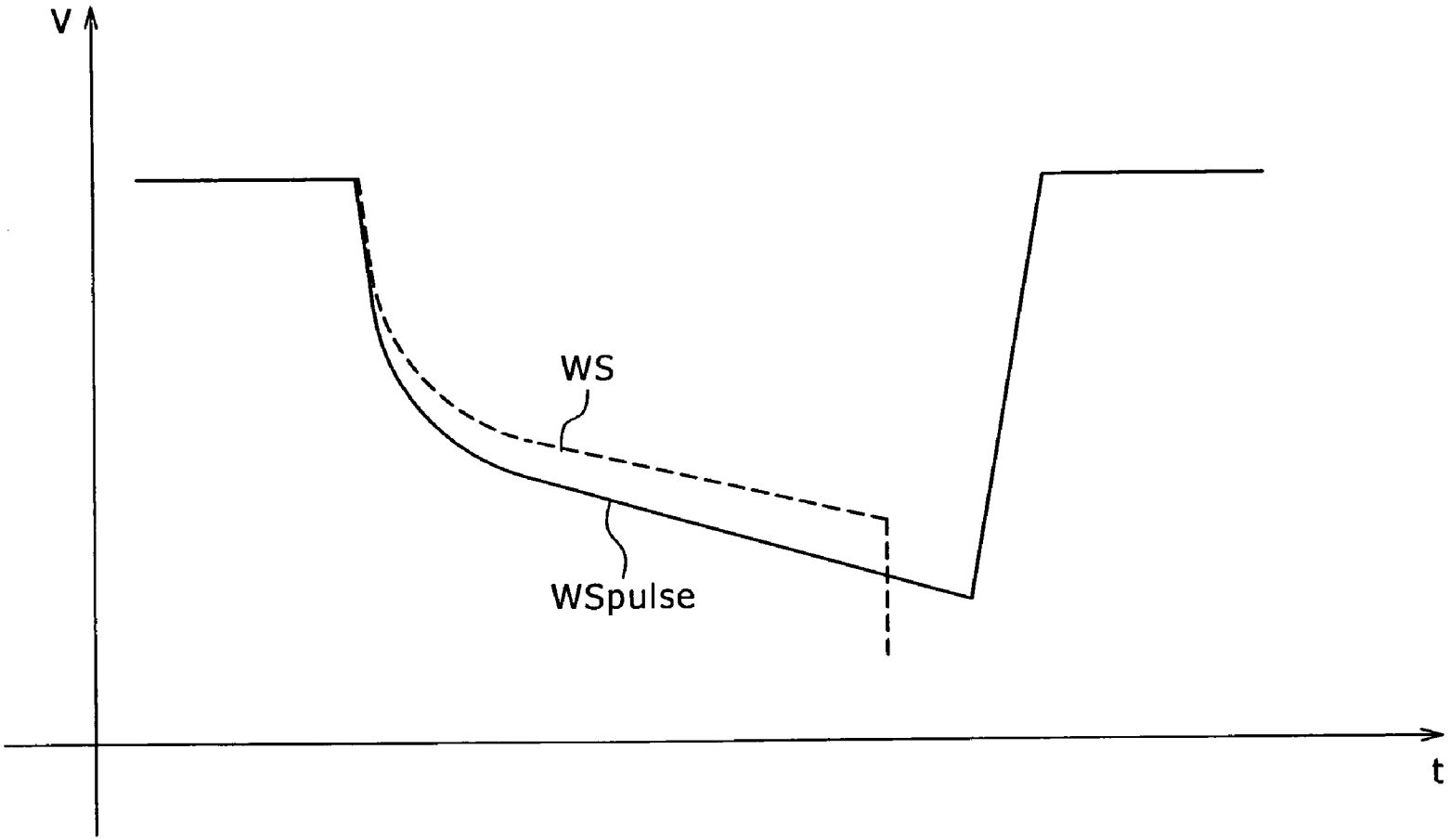
FIG. 14 is a waveform chart that aids in explaining the operations of the second embodiment.

FIG. 14 indicates a waveform for a case where a P-channel transistor WSTrP is used in place of the transmission gate WSTG with respect to the output buffer 4*b* shown in FIG. 11. When the power source pulse WSpulse generated outside of the panel is received at the P-channel transistor of the output section of the write scanner that is within the panel, it is modified due to the ON resistance of the transistor as shown in FIG. 14. When the voltage of the power source pulse WSpulse is high, the ON resistance of the P-channel transistor is small, and the waveform of the control signal WS is able to follow easily, and takes on an internal waveform that is substantially comparable to the external waveform WSpulse. On the other hand, as the voltage of the power source pulse WSpulse becomes low, the ON resistance of the P-channel transistor becomes greater, and the waveform of the control signal WS within the panel becomes modified. As opposed thereto, with the second embodiment, the element that receives the power source pulse waveform generated outside the panel is not a P-channel transistor (PMOS) but instead a transmission gate element (CMOS) that combines a P-channel transistor and a N-channel transistor. Since the CMOS utilizes a N-channel transistor in parallel with a P-channel transistor, it is possible, as shown in FIG. 13, to match the waveform generated outside the panel and the waveform within the panel regardless of level of the power source pulse WSpulse. As a result, the waveform within the panel can be controlled with ease from the outside.

Figure 15:
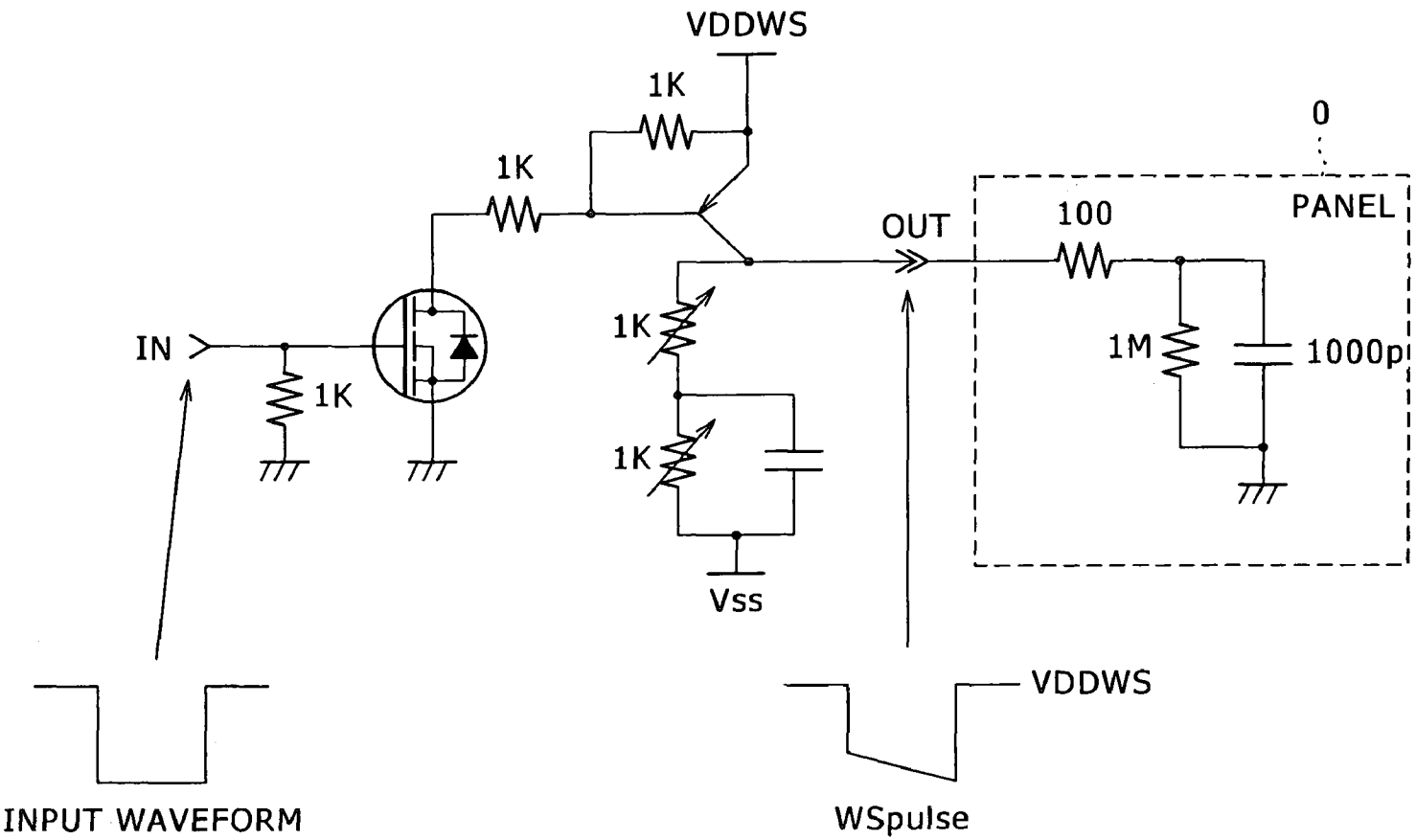
FIG. 15 is a circuit diagram indicating one example of a discrete circuit that generates a power source pulse.

With the second embodiment, the power source pulse having a curved gradient waveform is generated at the discrete circuit external to the panel in advance, and is inputted to the power line of the write scanner on the panel side. However, in order to create the curved gradient waveform precisely, the external discrete circuit tends to take on a complex configuration, thereby increasing the manufacturing cost. As an alternative, a discrete circuit that outputs a more simple alternative waveform is also useful. FIG. 15 indicates an example of such a discrete circuit with a simple structure. As shown in the diagram, this discrete circuit includes one transistor, one capacitance, three fixed resistors, and two variable resistors, processes a supplied input waveform IN in an analog fashion in synchrony with the sequential line scanning to generate the power source pulse WSpulse, and supplies it to the panel side. In this embodiment, a rectangular input waveform is processed to generate an output waveform where its trailing end changes in two stages in the form of a bent straight line. As shown in the diagram, the trailing end of the output waveform of this power source pulse WSpulse has a steep linear gradient at a first stage, and then switches to a gentler linear gradient at a second stage.

Figure 16:
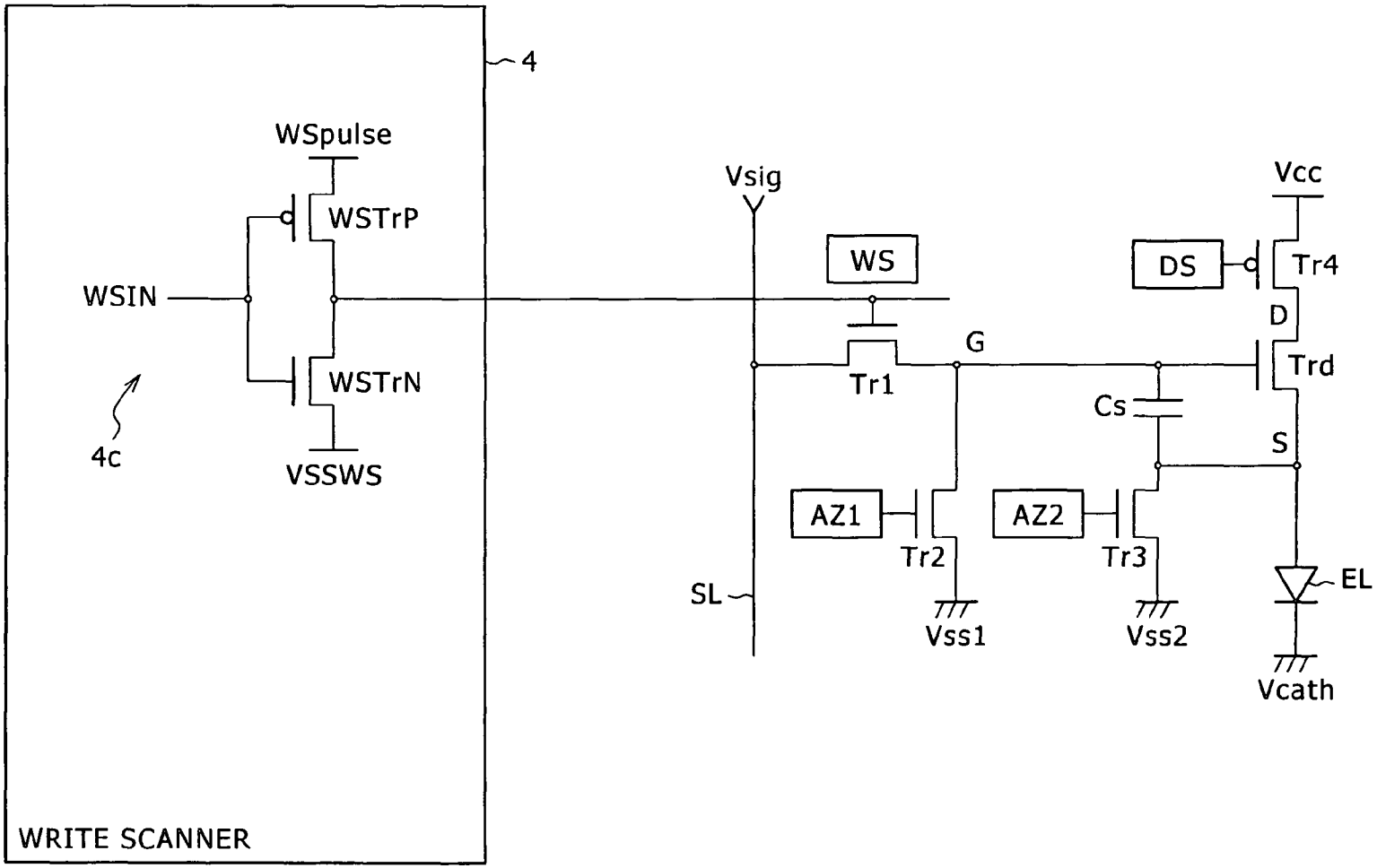
FIG. 16 is a circuit diagram indicating a third embodiment of a display apparatus according to the present invention.

The discrete circuit shown in FIG. 15 outputs the power source pulse WSpulse of a gradient waveform that bends linearly, and is not suitable for optimum mobility correction period control as this stage. FIG. 16 indicates a third embodiment of a write scanner output section according to an embodiment of the present invention which obtains a curved gradient waveform from a gradient waveform that bends linearly. In order to facilitate an easier understanding, parts corresponding to the second embodiment shown in FIG. 11 are given the same reference numerals/symbols. What differs is that the transmission gate WSTG that is included in the output section 4*b* of the second embodiment is substituted with a P-channel transistor WSTrP. As a result, an output section 4*c* of the third embodiment is such that its output buffer has a configuration where a P-channel transistor WSTrP and a N-channel transistor WSTrN are connected in series between the power line and the earth line VSSWS.

Figure 17:
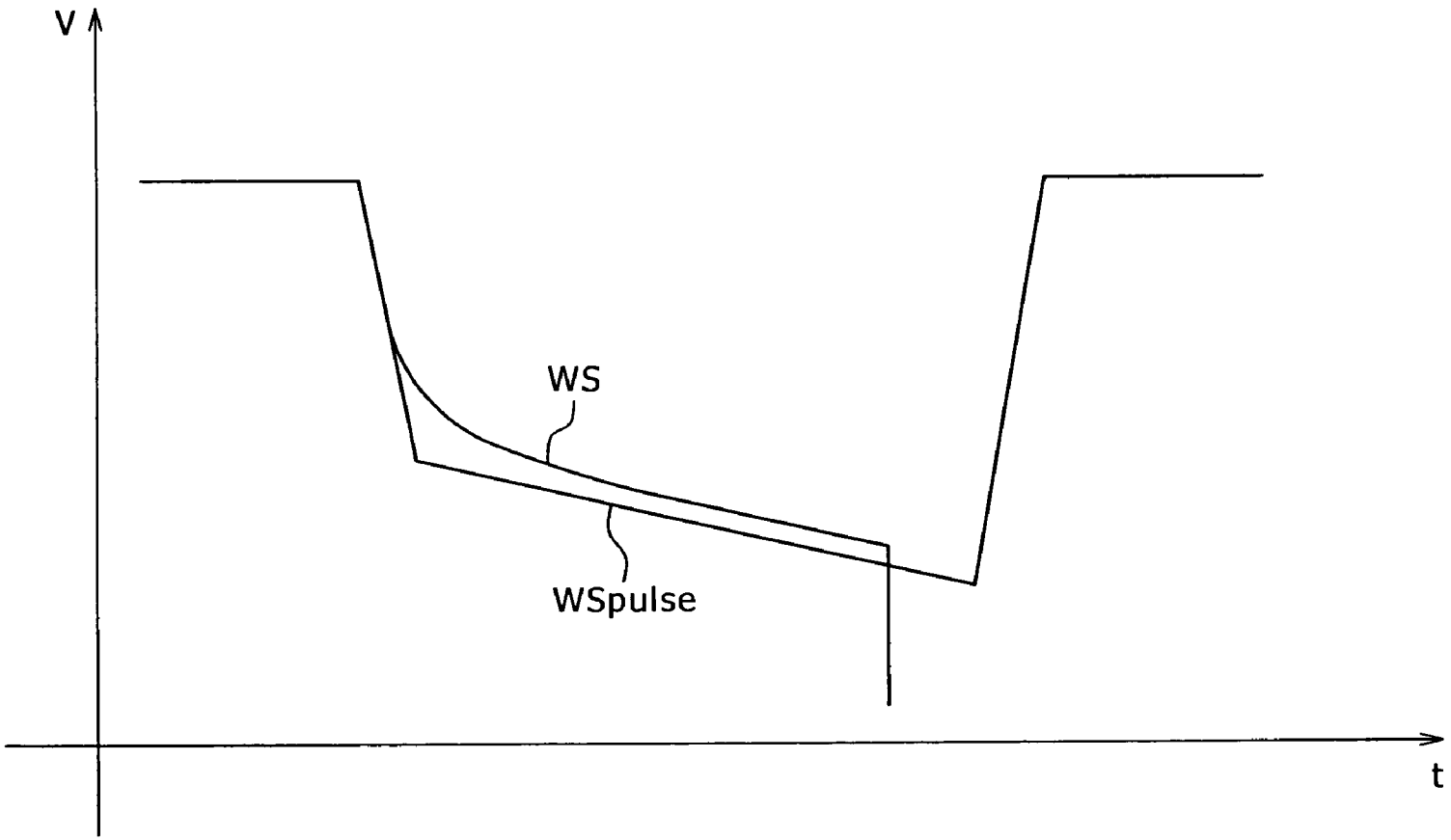
FIG. 17 is a waveform chart that aids in explaining the operations of the third embodiment.
Figure 18:
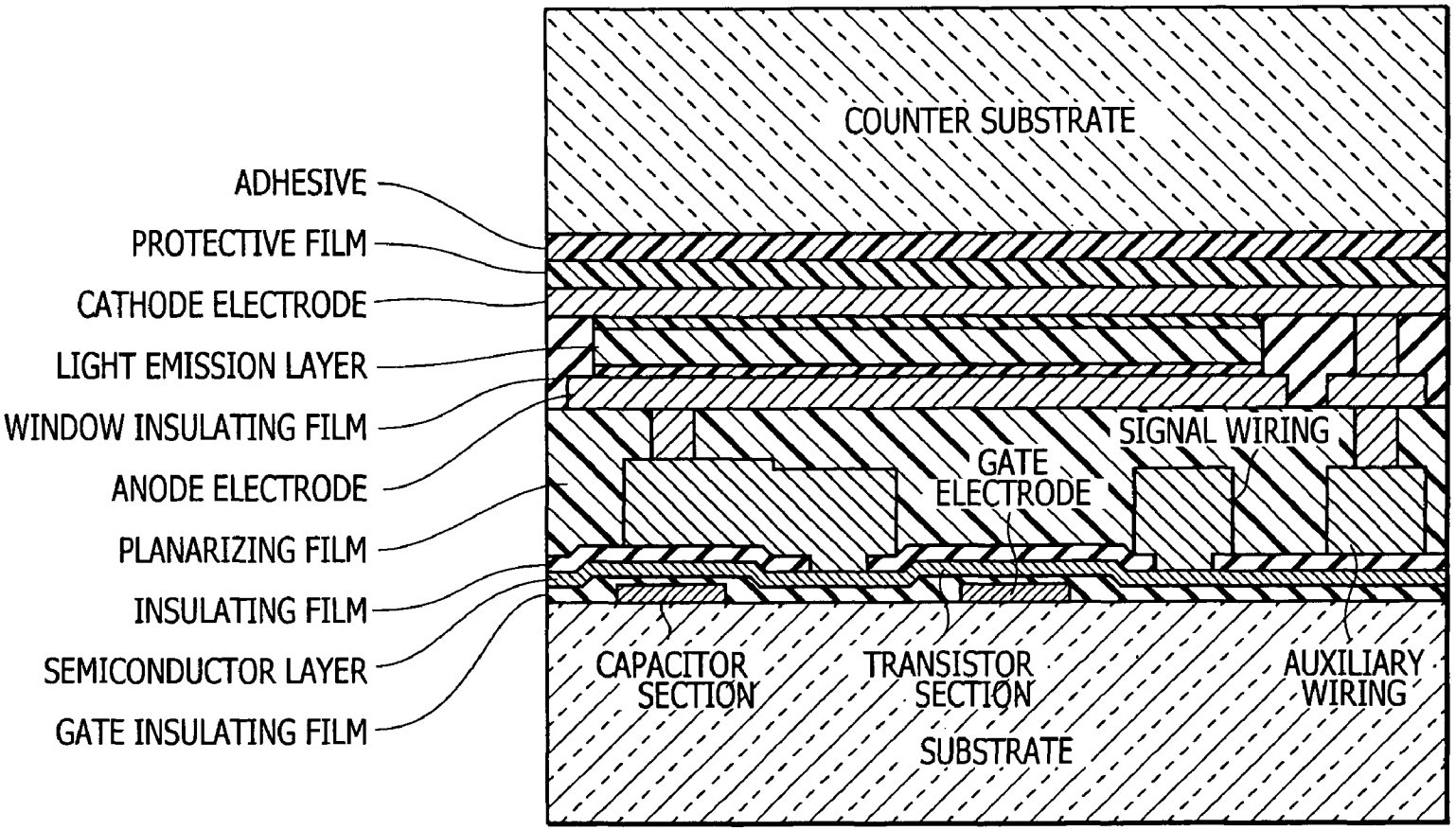
FIG. 18 is a sectional view indicating the device configuration of a display apparatus according to an embodiment of the present invention.

FIG. 17 indicates the waveform of the power source pulse WSpulse that is supplied to the output section 4*c* shown in FIG. 16 superimposed on the waveform of the control signal WS that is outputted from the same output section 4*c*. As shown in the diagram, the input power source pulse WSpulse is one that is supplied from the discrete circuit shown in FIG. 15, and has a waveform that bends linearly. As opposed thereto, the waveform of the control signal WS that is outputted from the output section 4*c* has a curved gradient waveform and has an ideal form. When the P-channel transistor WSTrP (PMOS) is used for the final stage buffer of the write scanner 4, the PMOS itself has such characteristics that where if the voltage of the power source pulse WSpulse is high, the ON resistance of the transistor is small and the trailing speed is fast, while if the voltage of the power source pulse WSpulse is low, the ON resistance of the transistor is large and the trailing speed is slow. As a result, it is possible to automatically convert the power source pulse WSpulse of a linear gradient waveform into the control signal WS of a curved gradient waveform. In some instances, the trailing speed may be appropriately adjusted by varying the size factor (W/L) of the transistor of the output buffer.

As described above, a display apparatus according to an embodiment of the present invention basically includes the pixel array section 1 and the drive section that drives it. The pixel array section 1 is equipped with the first scanning lines WS, the second scanning lines DS, which are arranged in rows, the signal lines SL that are arranged in columns, the matrix pixels 2 provided at a position where these lines cross one another, and the power lines Vcc that supply power to each of the pixels 2, and the earth line. The drive section includes the first scanner 4, which sequentially supplies the first control signal WS to the first scanning lines WS and sequentially line scans the pixels 2 row by row, the second scanner 5 which sequentially supplies the second control signal DS to each of the second scanning lines DS in conjunction with the sequential line scanning, and the signal selector 3 which supplies video signals to the columns of signal lines SL in conjunction with the sequential line scanning.

The pixels 2 include the light emitting element EL, the sampling transistor Tr1, the drive transistor Trd, the switching transistor Tr4, and the pixel capacitance Cs. The sampling transistor Tr1 has its gate connected to the first scanning line WS, its source connected to the signal line SL, and its drain connected to the gate G of the drive transistor Trd. The drive transistor Trd and the light emitting element EL are connected in series between the power line Vcc and the earth line, thereby forming a current path. The switching transistor Tr4 is inserted in this current path, while its gate is connected to the second scanning line DS. The pixel capacitance Cs is connected between the source S and the gate G of the drive transistor Trd.

With this configuration, the sampling transistor Tr1 turns on in accordance with the first control signal WS supplied from the first scanning line WS, samples the signal potential Vsig of the video signal supplied from the signal line SL and holds it in the pixel capacitance Cs. The switching transistor Tr4 turns on in accordance with the second control signal DS supplied from the second scanning line DS and turns the current path in a conductive state. In accordance with the signal potential Vsig held by the pixel capacitance Cs, the drive transistor Trd lets the drive current Ids flow to the light emitting element EL via the current path that is placed in a conductive state.

After the first control signal WS is applied to the first scanning line WS to turn on the sampling transistor Tr1 and the sampling of the signal potential Vsig is begun, the drive section (3, 4, 5) applies to the correction with respect to the mobility μ of the drive transistor Trd, to the thereby signal potential Vsig held by the pixel capacitance Cs performing mobility correction during the correction period t from the first timing T6, at which the switching transistor Tr4 turns on as the second control signal DS is applied to the second scanning line DS, up to the second timing T7, at which the sampling transistor Tr1 turns off as the first control signal WS applied to the first scanning line WS is terminated. In so doing, the drive section automatically adjusts the second timing T7 in such a manner that the correction period t becomes short when the signal potential Vsig of the video signal supplied to the signal line SL is high, while the correction period t becomes long when the signal potential Vsig of the video signal supplied to the signal line SL is low.

More specifically, the first scanner 4 of the drive section includes the output section (4*a*, 4*b*, 4*c*) that gives a gradient to the trailing end of the first control signal WS that governs the second timing T7. By outputting a curved gradient waveform where the gradient is initially made steep and then made more moderate, this output section optimizes the correction period t for both a case where the signal potential Vsig is high as well as a case where the signal potential Vsig is low.

In addition to the mobility correction function described above, each of the pixels 2 are equipped with a threshold Vth correction function for the drive transistor. In other words, the pixel 2 includes the additional switching transistors Tr2 and Tr3 that reset or initialize the gate potential (G) and the source potential (S) of the drive transistor Trd prior to the sampling of the video signal. The second scanner 5 temporarily turns on the switching transistor Tr4 via the second control line DS prior to the sampling of the video signal, and allows the drive current Ids to flow to the drive transistor Trd, which has thus been reset, thereby having a voltage corresponding to the threshold voltage Vth thereof to be held by the pixel capacitance Cs.

Figure 19:
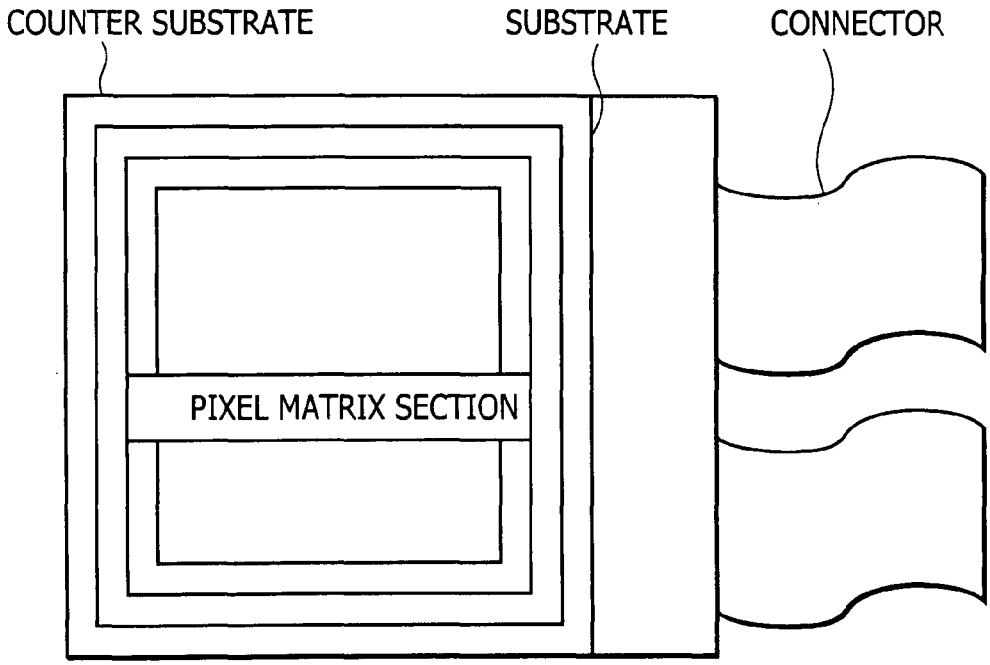
FIG. 19 is a plan view indicating the module configuration of a display apparatus according to an embodiment of the present invention.

A display apparatus according to an embodiment of the present invention may have such a thin film device configuration as the one shown in FIG. 19. The diagram indicates a schematic sectional structure of a pixel that is formed on an insulative substrate. As shown in the diagram, the pixel includes a transistor section that includes a plurality of thin film transistors (in the diagram, one TFT is shown as an example), a capacitance section, such as a retentive capacitance, and the like, and a light emitting section, such as an organic EL element and the like. The transistor section or the capacitance section is formed on the substrate by a TFT process, and thereon, the light emitting section, such as an organic EL element, is layered. A transparent counter substrate is adhered thereon via an adhesive, and a flat panel is thereby obtained.

Figure 20:
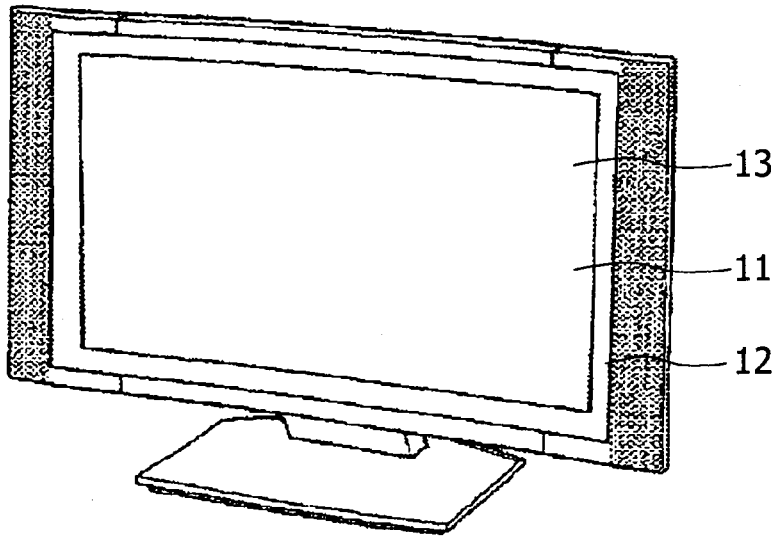
FIG. 20 is a perspective view indicating a television set equipped with a display apparatus according to an embodiment of the present invention.

A display apparatus according to an embodiment of the present invention includes a flat module type as shown in FIG. 20. For example, on an insulative substrate, a pixel array section in which pixels, each of which includes an organic EL element, a thin film transistor, a thin film capacitance and the like, are integrated and formed in a matrix is provided. An adhesive is provided in such a manner that it surrounds this pixel array section (pixel matrix section), a counter substrate of glass or the like is adhered, and a display module is thus obtained. This transparent counter substrate may be provided with a colour filter, a protective film, a light blocking film and the like as deemed necessary. The display module may be provided with, for example, a FPC (Flexible Print Circuit) as a connector for inputting and outputting signals from an external source to the pixel array section.

The display apparatus according to an embodiment of the present invention described above has a flat panel shape, and it may be applied to the display of a variety of electronic devices, such as digital cameras, laptop personal computers, mobile phones, video cameras and the like, which display video signals that are inputted thereto or generated within as images or as video. Below, examples of electronic devices to which such a display apparatus is applied are described.

Figure 21:
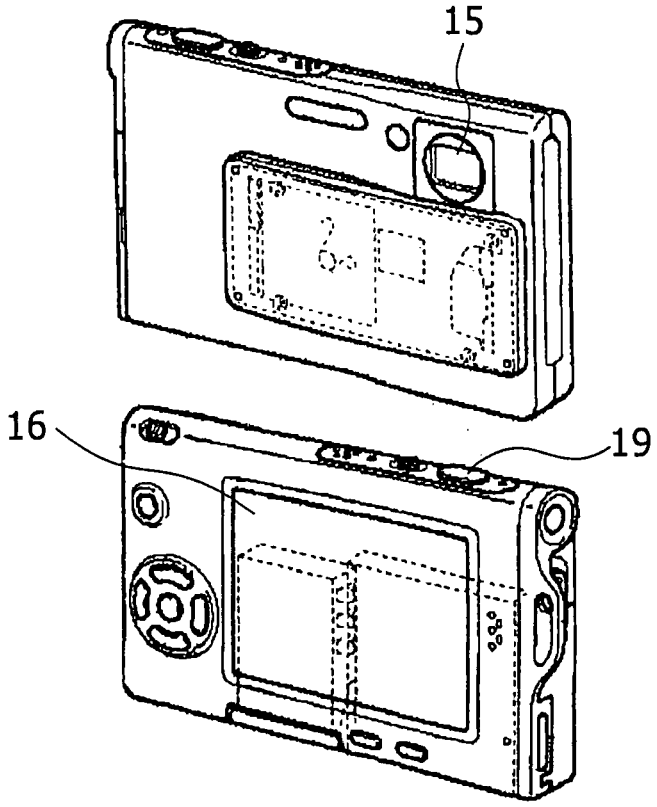
FIG. 21 is a perspective view indicating a digital still camera equipped with a display apparatus according to an embodiment of the present invention.

FIG. 21 shows a television set to which an embodiment of the present invention is applied, and includes an video display screen 11 that includes a front panel 12, a filter glass 13 and the like. It is produced by using a display apparatus of an embodiment of the present invention for its video display screen 11.

Figure 22:
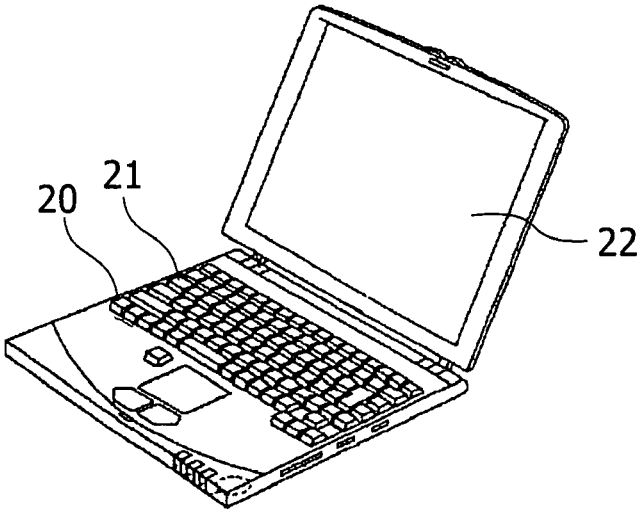
FIG. 22 is a perspective view indicating a laptop personal computer equipped with a display apparatus according to an embodiment of the present invention.

FIG. 22 shows a digital camera to which an embodiment of the present invention is applied, and the one on top is a front view and the one below is a rear view. This digital camera includes an imaging lens, a flash light emitting section 15, a display section 16, a control switch, a menu switch, a shutter 19 and the like, and is produced by using a display apparatus of the present embodiment for its display section 16.

Figure 23:
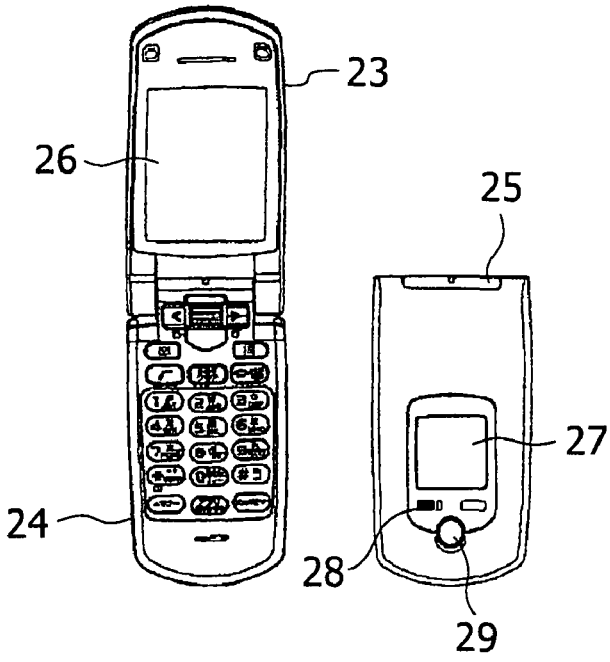
FIG. 23 is a schematic diagram indicating a portable terminal apparatus with a display apparatus according to an embodiment of the present invention.

FIG. 23 shows a laptop personal computer to which an embodiment of the present invention is applied. A main body 20 includes a keyboard 21 that is operated to input text and the like; a main body cover includes a display section 22 for displaying images and the like; and this personal computer is produced by using a display apparatus of the present embodiment for its display section 22.

Figure 24:
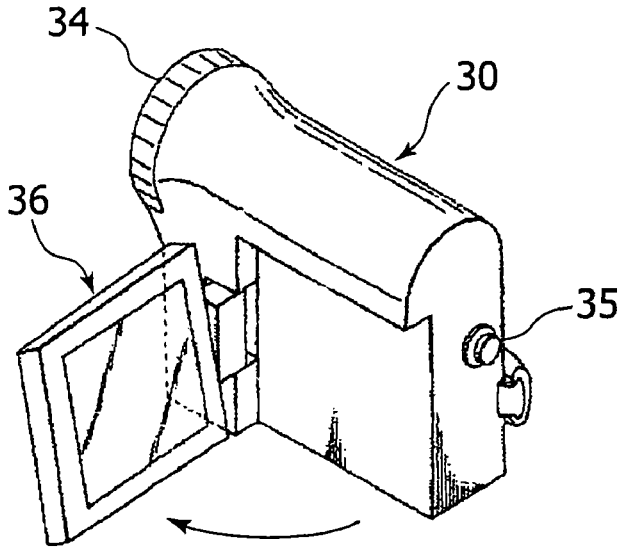
FIG. 24 is a perspective view indicating a video camera equipped with a display apparatus according to an embodiment of the present invention.

FIG. 24 shows a portable terminal apparatus to which an embodiment of the present invention is applied, and an opened state is shown on the left, while a closed state is shown on the right. This portable terminal apparatus includes an upper chassis 23, a lower chassis 24, a joint section (a hinge section in this case) 25, a display 26, a sub display 27, a picture light 28, a camera 29 and the like, and is produced by using a display apparatus of the present embodiment for its display 26 and/or its sub display 27.

FIG. 25 shows a video camera to which an embodiment of the present invention is applied. This video camera includes a main body section 30, a subject shooting lens 34 which faces forward, a start/stop switch 35 for shooting, a monitor 36 and the like, and is produced by using a display apparatus of the present embodiment for its monitor 36.

The present application claims benefit of priority of Japanese patent Application No. 2006-204055 filed in the Japanese Patent Office on Jul. 27, 2006, the entire content of which are incorporated herein by reference.

It should be understood by those skilled in the art that various modifications, combinations, subcombinations and alternations may occur depending on design requirements and other factors insofar as they are within the scope of the appended claims or the equivalents thereof.

What is claimed is:

1. A display apparatus, comprising:

a pixel array section; and a drive section that drives the pixel array section, wherein the pixel array section includes first scanning lines and second scanning lines arranged in rows, signals lines arranged in columns, matrix pixels that are provided at a position where the first scanning lines, the second scanning lines, and the signal lines cross, a power line that supplies power to each of the pixels, and an earth line, the drive section includes a first scanner that sequentially line scans the pixels per each row by sequentially supplying a first control signal to each of the first scanning lines, a second scanner that sequentially supplies a second control signal to each of the second scanning lines in conjunction with the sequential line scanning, and a signal selector that supplies video signals to the columns of signal lines in conjunction with the sequential line scanning, the pixel includes a light emitting element, a sampling transistor, a drive transistor, a switching transistor and a pixel capacitance, the sampling transistor has a gate connected to the first scanning line, a source connected to the signal line, and a drain connected to a gate of the drive transistor, the drive transistor and the light emitting element form a current path by being connected in series between the power line and the earth line, the switching transistor is inserted in the current path and its gate is connected to the second scanning line, the pixel capacitance is connected between a source and the gate of the drive transistor, the sampling transistor turns on in response to the first control signal supplied from the first scanning line, samples a signal potential of the video signal supplied from the signal line, and holds it in the pixel capacitance, the switching transistor turns on in response to the second control signal supplied from the second scanning line and turns the current path in a conductive state, the drive transistor allows a drive current corresponding to the signal potential held in the pixel capacitance to flow to the light emitting element via the current path that is placed in the conductive state, after starting the sampling of the signal potential by turning on the sampling transistor by applying the first control signal to the first scanning line, the drive section applies to the signal potential held by the pixel capacitance a correction with respect to a mobility of the drive transistor during a correction period, the correction period being a time period from a first timing at which the switching transistor turns on by having the second control signal applied to the second scanning line up to a second timing at which the sampling transistor turns off when the first control signal applied to the first scanning line is terminated, the first scanner includes an output section that gives a gradient to a trailing end of the first control signal that governs the second timing, and the output section optimizes the correction period for both a case where the signal potential is high and a case where the signal potential is low by outputting a curved gradient waveform that varies from an initially steep gradient to a more gentle gradient.

2. The display apparatus according to claim 1, wherein the output section of the first scanner includes an output buffer that is provided between the power line and the earth line and that includes a transmission gate, and the curved gradient waveform is extracted from a power source pulse that is supplied to the power line when the transmission gate opens in conjunction with the sequential line scanning, and is outputted to the first scanning line as the first control signal.

3. The display apparatus according to claim 1, wherein the output section of the first scanner includes an output buffer that is provided between the power line and the earth line and that includes a P-channel transistor, and a gradient waveform that bends linearly is extracted from a power source pulse that is supplied to the power line when the P-channel transistor opens in conjunction with the sequential line scanning, and is outputted to the first scanning line as the first control signal after being modified to the curved gradient waveform.

4. The display apparatus according to claim 1, wherein the output section of the first scanner includes an output buffer of an inverter configuration, and outputs to the first, scanning line the first control signal having the curved gradient waveform by blunting an input signal having a rectangular waveform.

5. The display apparatus according to claim 4, wherein the output section of the first scanner blunts the input signal of the rectangular waveform utilizing operating characteristics of a P-channel transistor included in the inverter configuration.

6. The display apparatus according to claim 4, wherein the output section of the first scanner blunts the input signal of the rectangular waveform by making a size factor of a transistor included in the inverter configuration smaller than a size factor of another transistor included in the first scanner.

7. The display apparatus according to claim 4, wherein the output section of the first scanner blunts a trailing waveform outputted from the output buffer to the curved gradient waveform utilizing a time constant that is determined by wiring resistance and wiring capacitance of the first scanning line.

8. The display apparatus according to claim 1, wherein each of the pixels includes an additional switching transistor that resets a gate potential and source potential of the drive transistor prior to the sampling of the video signal, and the second scanner temporarily turns on the switching transistor via the second scanning line prior to the sampling of the video signal, allows the drive current to flow to the drive transistor that is thus reset, and holds a voltage corresponding to a threshold voltage of the drive transistor in the pixel capacitance.

9. An electronic device comprising the display apparatus claimed in claim 1.

* * * * *